US011178985B2

(12) United States Patent
Bastian et al.

(10) Patent No.: US 11,178,985 B2
(45) Date of Patent: Nov. 23, 2021

(54) HANGING ASSEMBLY AND FRAME APPARATUS INCORPORATING THE SAME

(71) Applicant: MCS Industries, Inc., Easton, PA (US)

(72) Inventors: Geoffrey Bastian, Wind Gap, PA (US); Robert Terry Coyle, Jr., Palmer, PA (US)

(73) Assignee: MCS Industries, Inc.

( * ) Notice: Subject to any disclaimer, the term of this patent is extended or adjusted under 35 U.S.C. 154(b) by 116 days.

(21) Appl. No.: 16/414,009

(22) Filed: May 16, 2019

(65) Prior Publication Data

US 2019/0350387 A1 Nov. 21, 2019

Related U.S. Application Data

(60) Provisional application No. 62/673,278, filed on May 18, 2018.

(51) Int. Cl.

| | |
|---|---|
| ***A47G 1/16*** | (2006.01) |
| ***A47G 1/06*** | (2006.01) |
| *A47G 1/14* | (2006.01) |

(52) U.S. Cl.

CPC ..... *A47G 1/1626* (2013.01); *A47G 1/065* (2013.01); *A47G 1/0605* (2013.01); *A47G 1/142* (2013.01); *A47G 1/1613* (2013.01); *A47G 2001/0666* (2013.01); *A47G 2001/0694* (2013.01)

(58) Field of Classification Search

CPC .... A47G 1/1626; A47G 1/1613; A47G 1/065; A47G 2001/0694; A47G 1/16; A47G 1/0605; A47G 2001/0666; A47G 1/142

See application file for complete search history.

(56) References Cited

U.S. PATENT DOCUMENTS

| | | | | |
|---|---|---|---|---|
| 517,195 A | | 3/1894 | Schwartz | |
| 670,692 A | | 3/1901 | Solomon | |
| 2,740,603 A | * | 4/1956 | Wofford | A47G 1/1613 248/494 |
| 2,975,994 A | | 3/1961 | Goss | |
| 4,436,269 A | * | 3/1984 | Dirksing | E03D 9/032 248/214 |
| 6,003,825 A | * | 12/1999 | Abernathy, Jr. | A47G 1/164 248/478 |

(Continued)

FOREIGN PATENT DOCUMENTS

EP 2941151 B1 7/2017

*Primary Examiner* — Tan Le
(74) *Attorney, Agent, or Firm* — Belles Katz LLC

(57) ABSTRACT

A frame apparatus having an adjustable hanging height. The frame apparatus may include a frame having a mounting member thereon. The mounting member may extend along an axis and have a plurality of mounting elements located on opposite sides of the axis in an axially spaced apart manner. Furthermore, a mounting bracket is configured to be coupled to a support surface (i.e., a wall) and to the mounting member. The mounting bracket may extend along an axis and have a plurality of mounting elements located on opposite sides of the axis in an axially spaced apart manner. The frame may be hung from the support surface by engaging a subset of the mounting elements of the mounting member with the mounting elements of the mounting bracket. The mounting member and the mounting bracket may collectively form a hanging assembly for the frame apparatus.

20 Claims, 27 Drawing Sheets

(56) References Cited

U.S. PATENT DOCUMENTS

| | | | | |
|---|---|---|---|---|
| 6,663,075 | B2 | 12/2003 | Zuller | |
| 6,666,425 | B1 * | 12/2003 | Ferguson | A47G 1/202 248/476 |
| 6,694,656 | B2 * | 2/2004 | Flodin | A47G 1/143 40/748 |
| 8,356,778 | B2 * | 1/2013 | Birli | F16L 3/243 248/73 |
| 8,376,308 | B2 | 2/2013 | Greve | |
| 9,307,850 | B2 | 4/2016 | Azad | |
| 10,070,740 | B2 * | 9/2018 | Jacobs | F16M 11/046 |
| 10,939,774 | B2 * | 3/2021 | Coyle, Jr. | A47G 1/0611 |
| 2003/0029986 | A1 * | 2/2003 | Zuller | A47G 1/1626 248/476 |
| 2012/0241583 | A1 | 9/2012 | Potgieter | |
| 2019/0013772 | A1 * | 1/2019 | Bamat | H02S 20/23 |

* cited by examiner

HANGING ASSEMBLY AND FRAME APPARATUS INCORPORATING THE SAME

CROSS-REFERENCE TO RELATED APPLICATIONS

The present application claims priority to U.S. Provisional Patent Application Ser. No. 62/673,278, filed on May 18, 2018, the entirety of which is incorporated herein by reference.

BACKGROUND

Frames are used to hold an article or item that is desired to be displayed. Such frames may be hung from a wall or maintained in an upright but slightly angled orientation along a horizontal surface such as a desk or a shelf. For hanging applications, such frames typically include an aperture, a D-ring, or a sawtooth hanger that is configured to engage a piece of hardware, such as a screw or a nail, that is embedded within and protruding from the wall or other vertical or semi-vertical support surface. With such conventional frames, it is very important that the hardware is mounted to the wall at the exact location desired because there is no hanging height adjustability built into the frame itself. Rather, the height of the hardware dictates the hanging height of the frame. Thus, a need exists for a hanging assembly for a frame or a frame containing the same that includes mounting components that enable the hanging height of the frame to be adjusted without changing the location in the wall at which the hardware is located.

BRIEF SUMMARY

The present invention is directed to a frame apparatus having an adjustable hanging height. The frame apparatus may include a frame having a hanging assembly thereon. The hanging assembly may comprise a mounting member and a mounting bracket. The mounting member may extend along an axis and have a plurality of mounting elements located on opposite sides of the axis in an axially spaced apart manner. The mounting bracket may be configured to be coupled to a support surface (i.e., a wall) and to the mounting member. The mounting bracket may extend along an axis and have a plurality of mounting elements located on opposite sides of the axis in an axially spaced apart manner. The frame may be hung from the support surface by engaging a subset of the mounting elements of the mounting member with the mounting elements of the mounting bracket.

In one aspect, the invention may be a hanging assembly for hanging an article from a support surface, the hanging assembly comprising: a mounting member comprising a body portion extending along a first axis, a plurality of first mounting elements extending from the body portion on a first side of the first axis and arranged in an axially spaced apart manner, and a plurality of second mounting elements extending from the body portion on a second side of the first axis and arranged in an axially spaced apart manner; a mounting bracket extending along a second axis, the mounting bracket comprising a floor, a first sidewall extending from the floor on a first side of the second axis, and a second sidewall extending from the floor on a second side of the second axis, at least one third mounting element extending from an inner surface of the first sidewall towards the second axis and at least one fourth mounting element extending from an inner surface of the second sidewall towards the second axis; and wherein the mounting member is coupled to the mounting bracket via engagement between: (1) a first subset of the first mounting elements of the mounting member and the at least one third mounting element of the mounting bracket; and (2) a second subset of the second mounting elements of the mounting member and the at least one fourth mounting element of the mounting bracket In another aspect, the invention may be a frame apparatus comprising: a support structure comprising a frame; a first mounting member attached to or integrally formed with the support structure, the first mounting member comprising a base portion extending along a first axis, a plurality of first mounting elements located on a first side of the first axis and arranged in an axially spaced apart manner and a plurality of second mounting elements located on a second side of the first axis and arranged in an axially spaced apart manner; a mounting bracket configured to be coupled to a support surface and to the first mounting member to hang the frame from the support surface, the mounting bracket extending along a second axis, the mounting bracket comprising at least one third mounting element located on a first side of the second axis and at least one fourth mounting element located on a second side of the second axis; and wherein the first mounting member is configured to be coupled to the mounting bracket via engagement between: (1) a first subset of the plurality of first mounting elements of the first mounting member and the at least one third mounting element of the mounting bracket; and (2) a second subset of the plurality of second mounting elements of the first mounting member and the at least one fourth mounting element of the mounting bracket.

In yet another aspect, the invention may be a frame apparatus comprising: a frame comprising an inner surface defining a display opening, the inner surface having a first side, a second side opposite the first side, a third side extending between the first and second sides, and a fourth side opposite the third side and extending between the first and second sides; a reinforcement member extending from the first side of the inner surface to the second side of the inner surface, the reinforcement member comprising a mounting member, the mounting member comprising a base portion extending along a first axis, a plurality of first mounting elements located on a first side of the first axis, and a plurality of second mounting elements located on a second side of the first axis; a mounting bracket integrally formed with the frame and alterable between: (1) a first state in which the mounting bracket is attached to the frame; and (2) a second state in which the mounting bracket is detached from the frame so that the mounting bracket can be mounted to a support surface; and wherein in the second state, the mounting bracket can be coupled to the frame by engagement between coupling elements of the mounting bracket and one or more of the first mounting elements and one or more of the second mounting elements of the mounting member.

In a further aspect, the invention may be a hanging assembly for hanging a frame apparatus from a support surface, the hanging assembly comprising: a mounting member configured to be coupled to the frame apparatus, the mounting member comprising a body portion extending along a first axis, a plurality of first mounting elements extending from the body portion on a first side of the first axis, and a plurality of second mounting elements extending from the body portion on a second side of the first axis, each of the first and second mounting elements comprising a protrusion and a stopper rib; a mounting bracket configured to be coupled to a support surface, the mounting bracket comprising a body portion extending along a second axis, a plurality of third mounting elements extending from the body portion on a first side of the second axis, and a plurality of fourth mounting elements extending from the body portion on a second side of the second axis; and wherein the mounting member is coupled to the mounting bracket to hang the frame apparatus from the support surface via engagement between: (1) a first subset of the first mounting elements of the mounting member and the plurality of third mounting elements of the mounting bracket, such that each of the stopper ribs of the first subset of the first mounting elements of the mounting member rests atop one of the third mounting elements of the mounting bracket and each of the protrusions of the first subset of the first mounting elements of the mounting member is positioned behind one of the third mounting elements of the mounting bracket; and (2) a second subset of the second mounting elements of the mounting member and the plurality of fourth mounting elements of the mounting bracket, such that each of the stopper ribs of the second subset of the second mounting elements of the mounting member rests atop one of the fourth mounting elements of the mounting bracket and each of the protrusions of the second subset of the second mounting elements of the mounting member is positioned behind one of the fourth mounting elements of the mounting bracket.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1A:
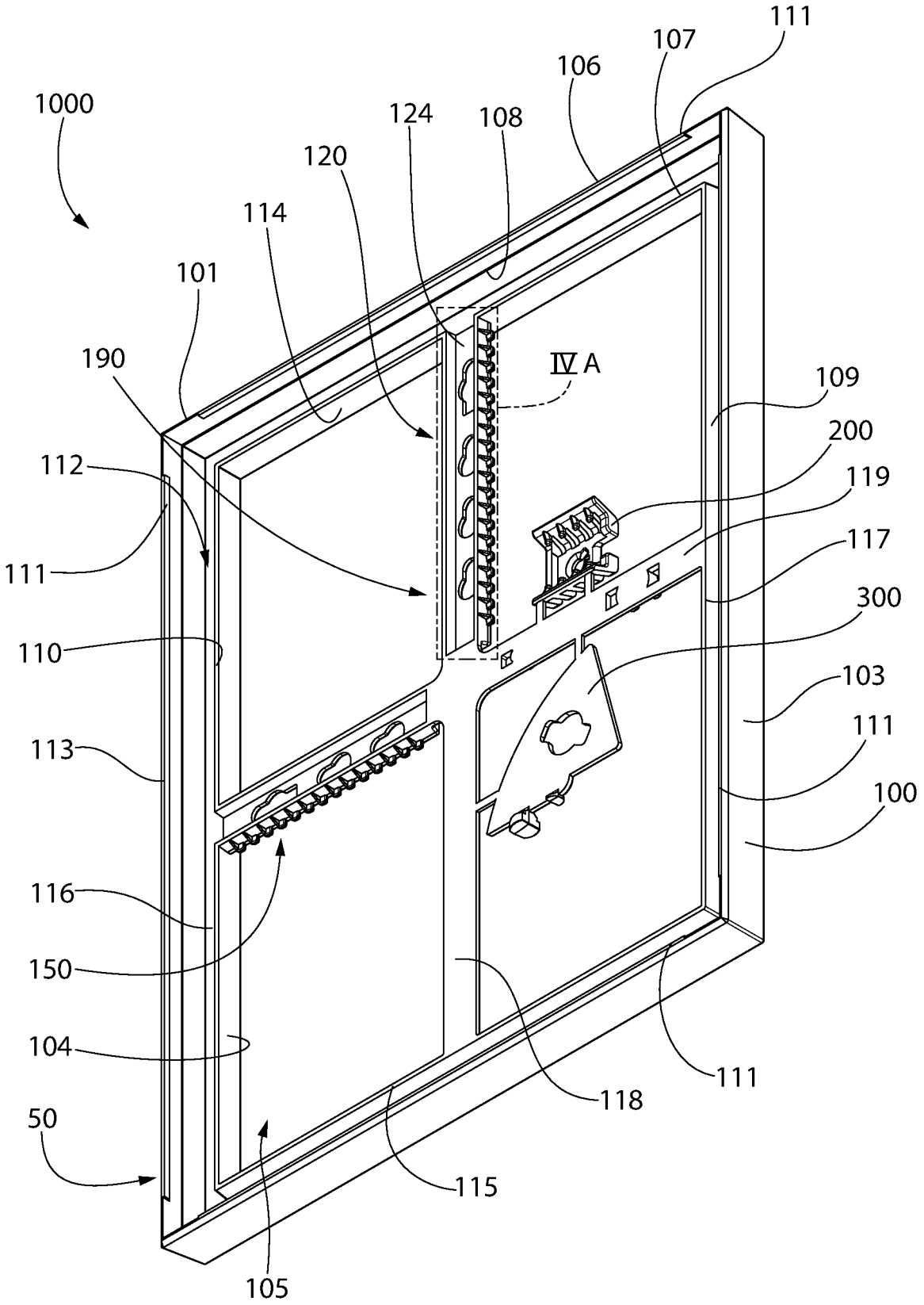
FIG. 1A is a rear perspective view of a frame apparatus having a frame with an integral hanging assembly and stand in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 1B:
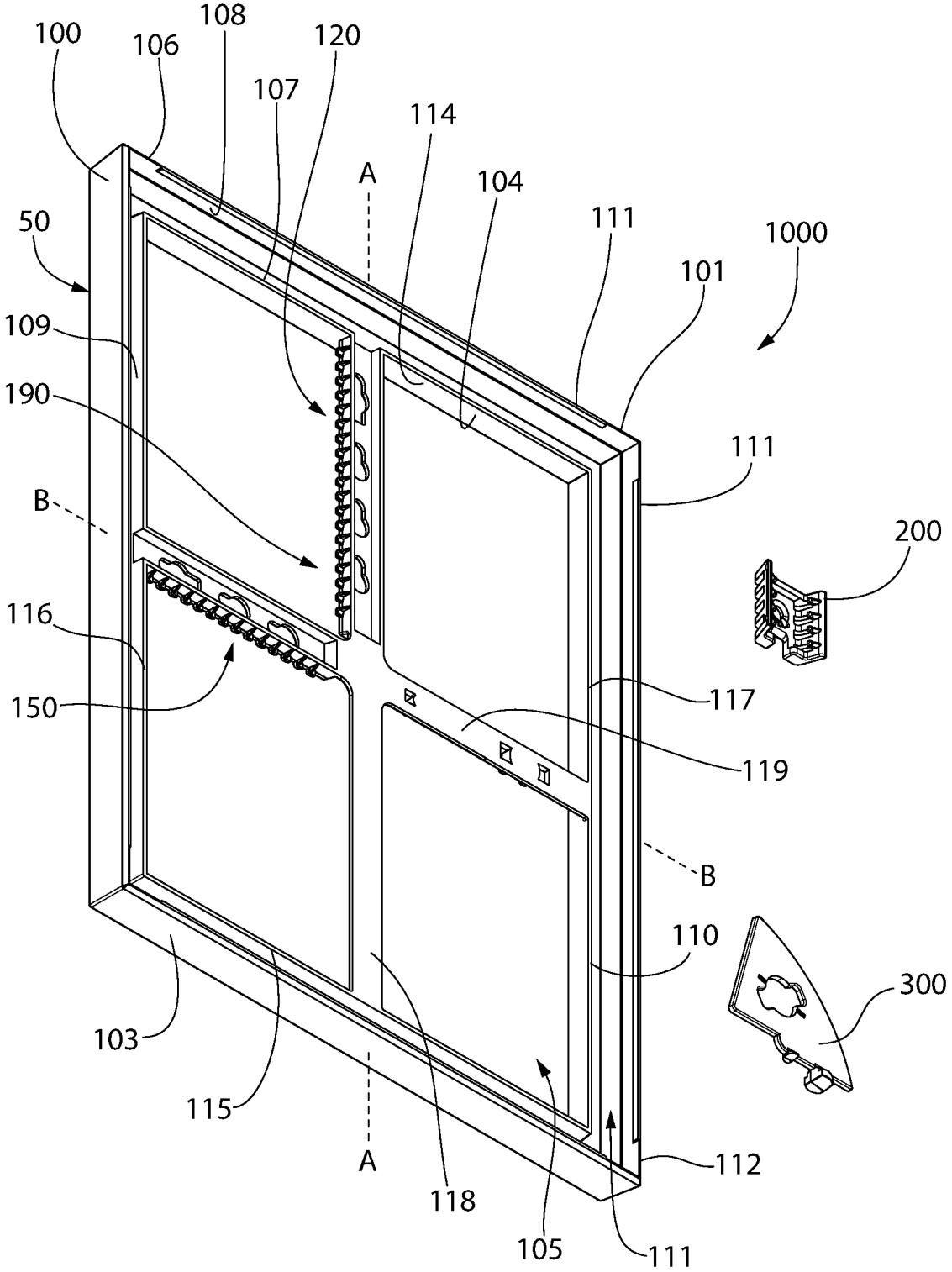
FIG. 1B is the rear perspective view of the frame apparatus of FIG. 1A with the stand and a mounting bracket of the hanging assembly detached from the frame.
Figure 2:
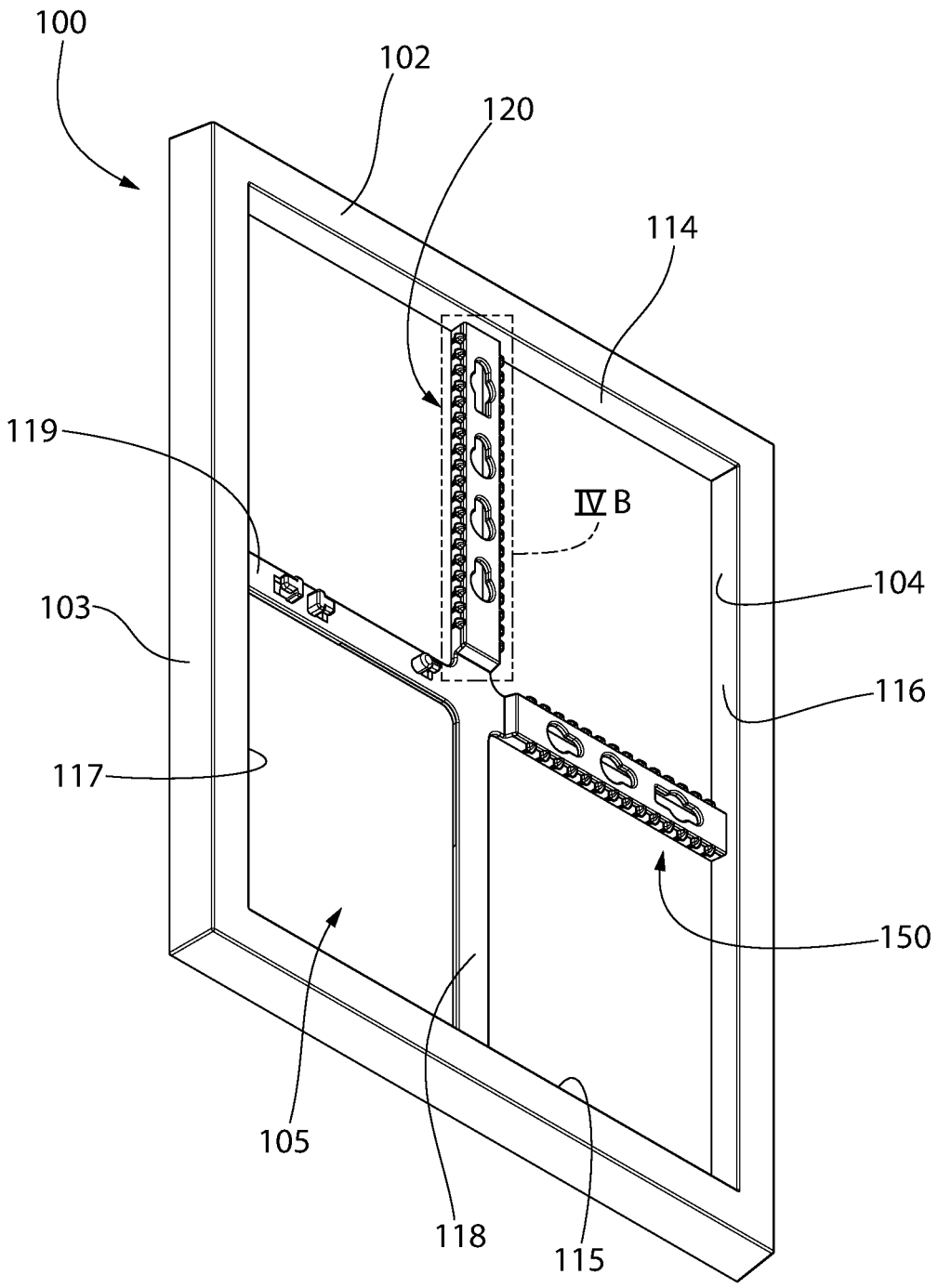
FIG. 2 is a front perspective view of the frame of the frame apparatus of FIG. 1.

Referring to FIGS. 1A and 1B, a frame apparatus 1000 is illustrated in accordance with an embodiment of the present invention. The frame apparatus 1000 generally comprises a support structure 50, a hanging assembly 190, and a support stand 300. The hanging assembly 190 is used to hang the frame apparatus 1000 from a support surface such as a wall and the support stand 300 is used to support the frame apparatus 1000 on a horizontal surface such as a desk, a countertop, a table, or the like. These different techniques/structures for hanging/supporting the support structure 50 will be described in greater detail later on in this document, although a brief explanation and description of the hanging assembly 190 will be provided immediately below. In some embodiments, the hanging assembly 190 may form the invention.

In the exemplified embodiment the hanging assembly 190 comprises a first mounting member 120, a second mounting member 150, and mounting bracket 200. In the exemplified embodiment the first and second mounting members 120, 150 are either integrally formed with or otherwise coupled to the support structure 50. The mounting bracket 200 is configured to be mounted to a support surface and then one of the first and second mounting members 120 is configured to be coupled to the mounting bracket 200 to hang the support structure 50 from the support surface. It should be appreciated that the structure of the first and second mounting elements 120, 150 may be swapped with the structure of the mounting bracket 200 and vice versa. If the support structure 50 is to be hung in a portrait orientation, the first mounting member 120 will be coupled to the mounting bracket 200 to hang the support structure 50 from the support surface. If the support structure 50 is to be hung in a landscape orientation, the second mounting member 150 will be coupled to the mounting bracket 200 to hang the support structure 50 from the support surface. Although in the exemplified embodiment the hanging assembly 190 comprises the first mounting member 120 and the second mounting member 150, in other embodiments the hanging assembly 190 may comprise only one of the first and second hanging members 120, 150 (while also comprising the mounting bracket 200).

In the exemplified embodiment, the hanging assembly 190 is formed as an integral part of the support structure 50, and more specifically a frame 100 of the support structure 50. This is because in the exemplified embodiment of FIGS. 1A and 1B, the frame 100 is a unitary structure formed from plastic or other similar material that can be extruded or injection molded. However, it should be appreciated that the hanging assembly 190 may be used with other types of support structures and frames, for example wood or metal frames that include a backer panel for retaining the framed item in the frame. Thus, in some such alternative embodiments, the hanging assembly 190 may be separate from the support structure 50 such that the hanging assembly 190 or portions thereof may be coupled to the support structure 50 for hanging the support structure 50 from a support surface such as a wall. Thus, as will be discussed further below with reference to FIGS. 11A-12B, the hanging assembly 190 may be a stand-alone assembly that is manufactured separately from the support structure 50 and later coupled thereto for purposes of hanging the support structure 50 from a wall or the like.

The support structure 50 generally comprises a frame 100 and a stack 60 (FIG. 6C) that is positioned within a rabbet of the frame 100. The stack 60 may include a glazing 61, a backer panel 62, and may optionally also include an item or article 63 that is intended to be supported by the frame 100 for display at a desired location (see FIG. 6C). The frame apparatus 1000 will typically be sold with the glazing 61 and the backer panel 62 and the end-user will add the item or article 63, and thus the stack 60 may refer to just the glazing 61 and the backer panel 62 or it may refer to the glazing 61, the backer panel 62, and the item 63. In some embodiments the stack 60 may comprise the glazing 61. The mounting bracket 200 of the hanging assembly 190 and the support stand 300 may be referred to herein as support members in some embodiments because each of the mounting bracket 200 and the support stand 300 are configured to support the frame 100 at a desired location. Specifically, the mounting bracket 200 is configured to support the frame 100 from a vertical support surface such as a wall and the support stand 300 is configured to support the frame 100 from a horizontal support surface such as a desktop, countertop, shelf, or the like.

In the exemplified embodiment, the frame apparatus 1000 is integrally formed as a monolithic component that includes the frame 100, the hanging assembly 190, and the support stand 300. Thus, in its originally formed state, the mounting bracket 200 and the support stand 300 are integrally coupled to the frame 100 as shown in FIG. 1. In this embodiment, the mounting members 120, 150 form an integral part of the frame 100 as well. The mounting bracket 200 and the support stand 300 are integrally formed with the frame 100 in a detachable manner such that they can be detached from the frame 100 for purposes of supporting the frame 100 on or from a desired surface. In certain embodiments, the frame apparatus 100 may be formed by injection molding, although other manufacturing techniques may be used in other embodiments. The frame apparatus 1000 (including the frame 100, the hanging assembly 190, and the support stand 300) is preferably formed of plastic, although other materials may be used in other embodiments.

Although the mounting bracket 200 and the support stand 300 are integrally formed with the frame 100, the mounting bracket 200 and the support stand 300 can be detached from the frame 100 as shown in FIG. 1B. Specifically, the mounting bracket 200 and the support stand 300 may be detached from the frame 100 by pulling and twisting the mounting bracket 200 and the support stand 300 relative to the frame 100 until separation is achieved. Once detached from the frame 100, the mounting bracket 200 and the support stand 300 can be used to support the frame 100, although typically only one of the mounting bracket 200 and the support stand 300 is used at a time. As will be discussed below with reference to FIGS. 10A-10C, the one of the mounting bracket 200 and the support stand 300 that is not being used at any given time can be stored via engagement with storage protuberances on the frame 100.

Referring to FIGS. 1A-3, the frame 100 will be further described. The frame 100 comprises a front surface 101, a rear surface 102, an outer surface 103, and an inner surface 104 that defines a display opening 105. The frame 100 has an outer annular wall 106 and an inner annular wall 107 that are spaced apart from one another such that the outer annular wall 106 surrounds the inner annular wall 107. The outer and inner annular walls 106, 107 are connected to one another along the rear surface 102 of the frame 100, but not along the front surface 101 of the frame 100. Thus, a channel 112 exists between the outer and inner annular walls 106, 107, the channel 112 having an opening 113 at the front surface 101 of the frame 100. In the exemplified embodiment, the frame 100 is a front-loading frame although the invention is not limited to front-loading frames in all embodiments.

The outer annular wall 106 has a greater height than the inner annular wall 107 measured from the front surface 101 to the rear surface 102, thereby creating a rabbet 110 for supporting the stack 60 (which may comprise the glazing 61, the backer panel 62, and the item/article 63 to be framed such as a photograph, picture, diploma, certificate, or the like). Specifically, a distal end of the inner annular wall 107 forms a floor of the rabbet 110 upon which the stack 60 may be located. The outer annular wall 106 comprises the outer surface 103 of the frame 100 and an inner surface 108 and the inner annular wall 107 comprises the inner surface 104 of the frame 100 and an outer surface 109. One or more protuberances 111 protrude from the inner surface 108 of the outer annular wall 106 adjacent to a distal end of the outer annular wall 106 to assist in retaining the stack within the rabbet 110. Specifically, the stack 60 is retained within the rabbet 110 by being trapped between the distal end of the inner annular wall 107 and the protuberances 111. Of course, other features may be included instead of or in addition to the protuberances 111 to achieve this retention function, such as clips, turn buttons, glazier points, rivets, or the like.

The inner annular wall 107 comprises a first side 114, a second side 115 opposite the first side 114, a third side 116, and a fourth side 117 opposite the third side 116. The third and fourth sides 116, 117 extend between the first and second sides 114, 115. A first reinforcement member 118 extends from the first side 114 of the inner annular wall 107 to the second side 115 of the inner annular wall 107, the first reinforcement member 118 being located equidistant to the third and fourth sides 116, 117. A second reinforcement member 119 extends from the third side 116 of the inner annular wall 107 to the fourth side 117 of the inner annular wall 107, the second reinforcement member 119 being located equidistant to the first and second sides 114, 115. In the exemplified embodiment, the first and second reinforcement members 118, 119 are elongated members that are oriented perpendicular to one another. Specifically, the first reinforcement member 118 extends along a first axis A-A and the second reinforcement member 119 extends along a second axis B-B that is perpendicular to the first axis A-A. However, the exact relative orientation between the first and second reinforcement members 118, 119 is not to be limiting of the invention in all embodiments and they may be oblique in other embodiments. The first and second reinforcement members 118, 119 provide some structural rigidity to the frame 100 because without them it might be flimsy, particularly if it is formed out of plastic in an injection molding process. In some embodiments, only one of the first and second reinforcement members 118, 119 may be included with the other being omitted.

In the exemplified embodiment, the first reinforcement member 118 comprises the first mounting member 120 of the hanging assembly 190 and the second reinforcement member 119 comprises the second mounting member 150 of the hanging assembly 190. The first and second mounting members 120, 150 are very similar if not identical structurally, and thus for purposes of brevity only the details of the first mounting member 120 will be provided herein below. However, it should be appreciated that the description of the first mounting member 120 is equally applicable to the second mounting member 150. In general, only one of the first and second mounting members 120, 150 will be used at a given time to hang the frame 100 from a vertical surface such as a wall depending on the orientation at which the frame 100 is desired to be hung from the vertical surface (the first mounting member 120 is used for portrait orientation and the second mounting member 150 is used for landscape orientation). As used herein, the term "vertical surface" is not limited to one that is perpendicular to the horizon but may also include one that is slightly angled relative to the vertical, such as by 0-10°.

The first and second mounting members 120, 150 are attached to the support structure 50. In the exemplified embodiment, the first and second reinforcement members 118, 119, and hence also the first and second mounting members 120, 150, are integrally formed with the frame 100 and may in some embodiments be deemed to form a part of the frame 100. However, in other embodiments the first and second mounting elements 120, 150 may be formed separately from the frame 100 and coupled thereto (see, for example, FIGS. 11A-12B and the accompanying description). Thus, as used herein, stating that the first and second mounting members 120, 150 are "attached" or "coupled" to the support structure 50 includes instances where the first and second mounting members 120, 150 are integrally formed with the frame 100 (i.e., FIGS. 1-3) and instances where the first and second mounting members 120, 150 are formed separately from the support structure 50 and frame 100 and coupled thereto, either by coupling the first and second mounting members 120, 150 to the frame 100 of the support structure 50 or the stack 60 of the support structure (i.e., FIGS. 11A-12B).

Figure 3:
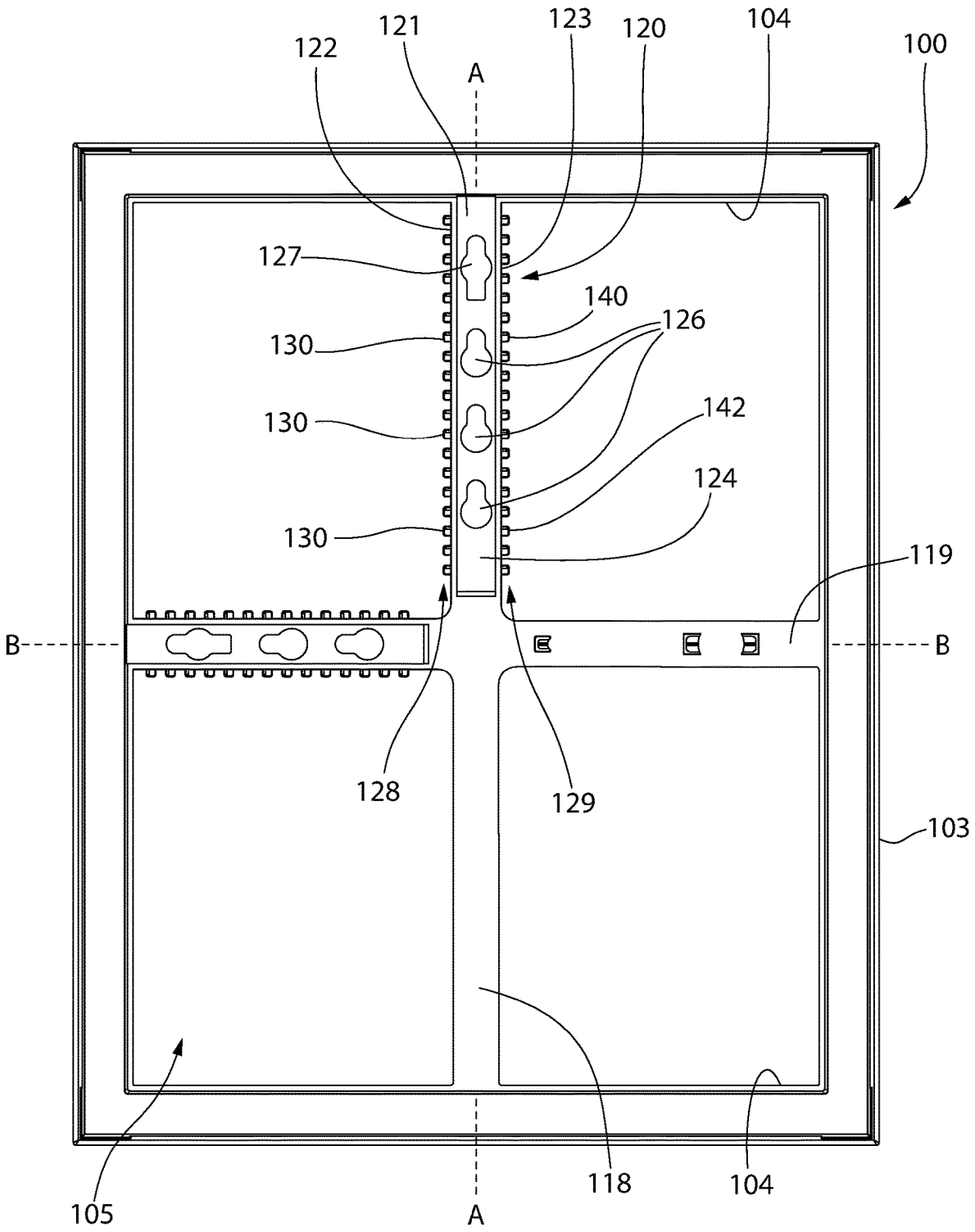
FIG. 3 is a rear view of the frame of the frame apparatus of FIG. 1.
Figure 4A:
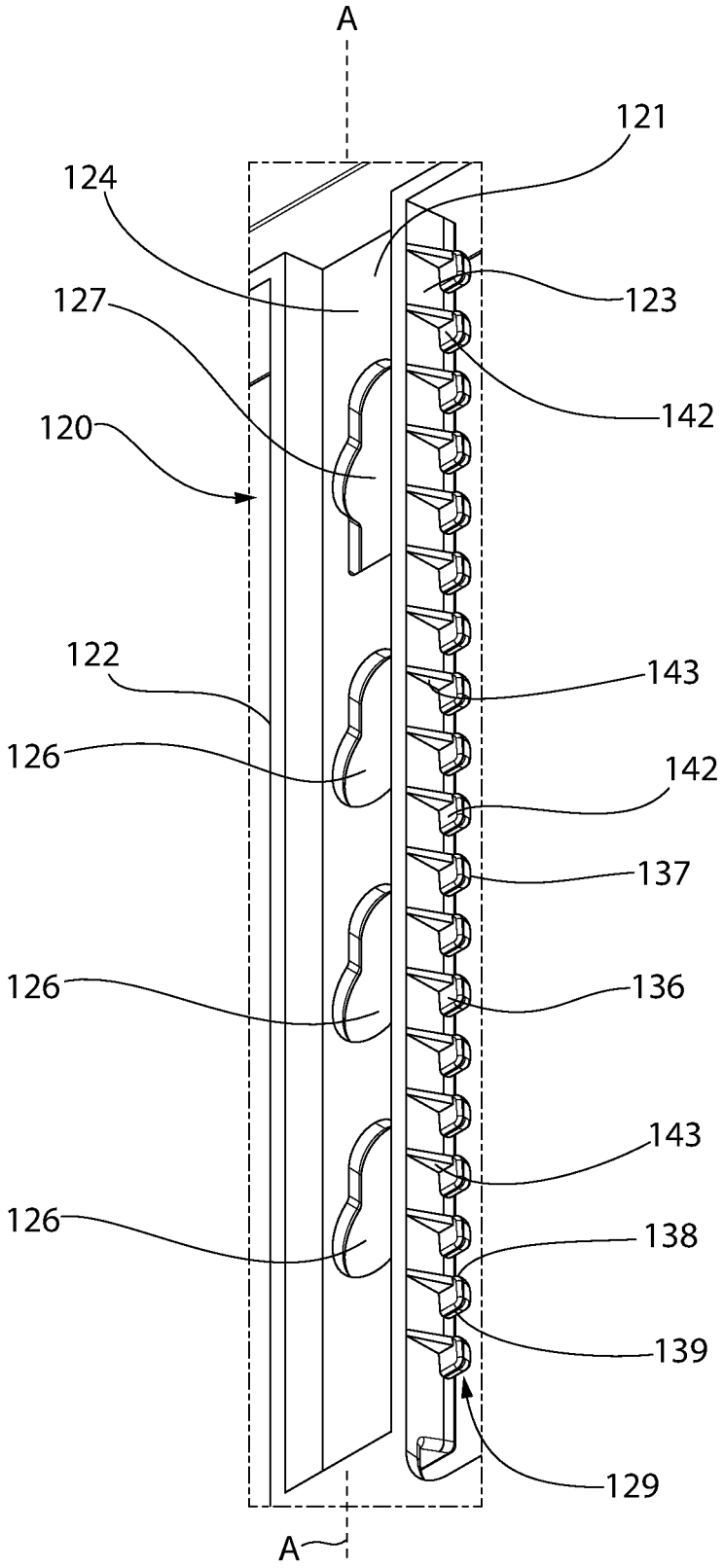
FIG. 4A is a close-up view of area IVA of FIG. 1A illustrating a mounting member of the hanging assembly.
Figure 4B:
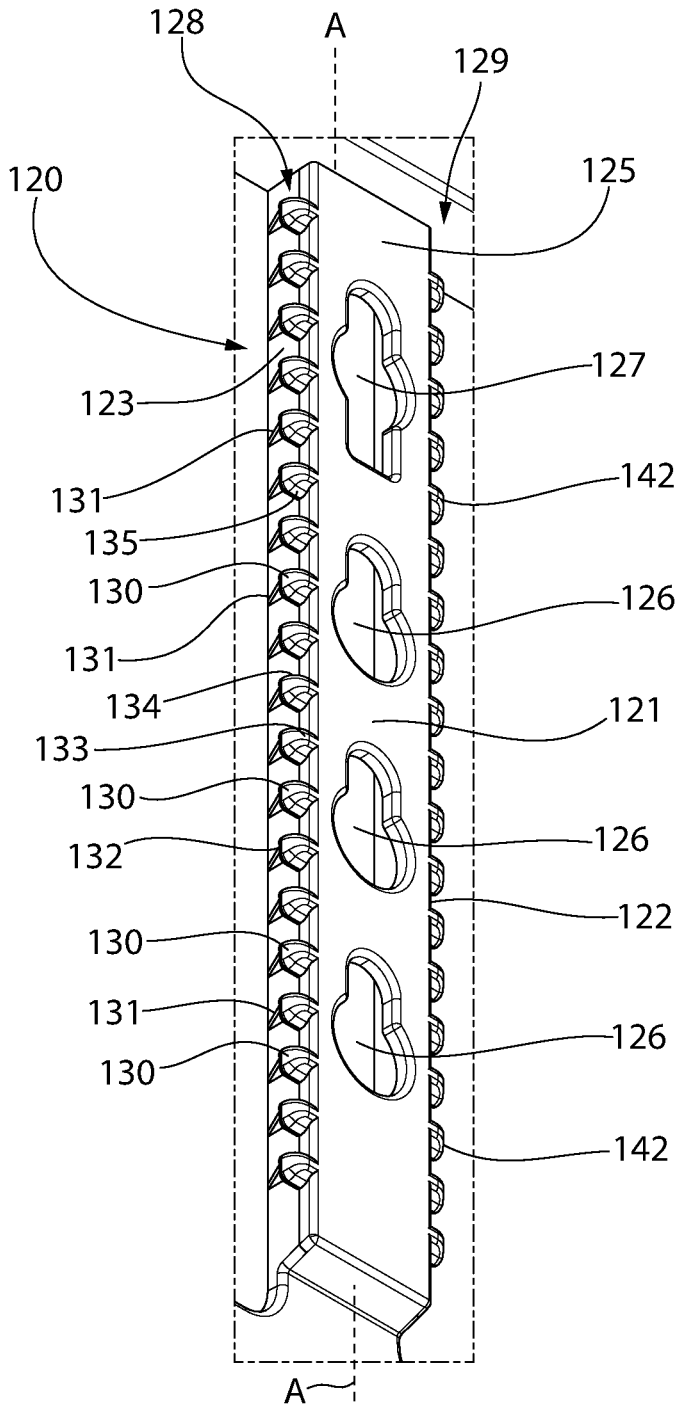
FIG. 4B is a close-up view of area IVB of FIG. 2 illustrating the mounting member of the hanging assembly.

The details of the first mounting member 120 will be described with reference to FIGS. 3, 4A, and 4B. As mentioned above, the second mounting member 150 is very similar to the first mounting member 150 and thus it will not be described separately in great detail, it being understood that the description of the first mounting member 120 is applicable. Structurally, there is no difference between the first and second mounting members 120, 150 in the exemplified embodiment. The main difference is in their orientation, such that the first mounting member 120 is elongated along the first axis A-A and the second mounting member 150 is elongated along the second axis B-B, which is perpendicular to the first axis A-A.

The first mounting member 120 comprises a body portion 121 that extends and is elongated along the first axis A-A. The body portion 121 has a first side 122 located on a first side of the axis A-A and a second side 123 located on a second side of the axis A-A. The body portion 121 also has a front surface 124 and a rear surface 125 opposite the front surface 124. Furthermore, a plurality of hanging apertures 126 are formed through the body portion 121 from the front surface 124 to the rear surface 125. The plurality of hanging apertures 126 are axially spaced apart along the first axis A-A. Each of the hanging apertures 126 is configured to receive a portion of a piece of hardware (i.e., a screw, nail, or the like) that is protruding from a support surface to hang the frame 100 from the support surface. In the exemplified embodiment, each of the hanging apertures 126 has a receiving section and a nesting section, the receiving section having a larger cross-sectional area than the nesting section. The head of a screw/nail can pass through the receiving section but has a larger cross section than the nesting section to prevent the frame 100 from readily detaching from the screw/nail. Although the specific shape/structure of the hanging apertures 126 may be conventional, the fact that there are a plurality of them (three in the exemplified embodiment, although there could be two or more than three in other embodiments) positioned in an axially spaced apart manner enables the frame 100 to be hung at different elevations without changing the location of the hardware from which hit is hanging.

In addition to the hanging apertures 126, there is one additional aperture 127 located closest to the inner surface 104 of the frame 100. The additional aperture 127 can be used to hang the frame 100 from a vertical surface just like the hanging apertures 126, or it may be used to couple the support stand 300 to the frame 100 as described in more detail below. The additional aperture 127 has a different shape than the hanging apertures 126.

The first mounting member 120 further comprises a plurality of first mounting elements 128 located on a first side of the first axis A-A and a plurality of second mounting elements 128 located on a second side of the first axis A-A. In the exemplified embodiment, each of the first mounting elements 128 protrude from the first side 122 of the body portion 121 in a direction away from the first axis A-A and each of the second mounting elements 128 protrude from the second side 123 of the body portion 121 in a direction away from the first axis A-A. The plurality of first mounting elements 128 are arranged in an axially spaced apart manner so that each of the first mounting elements 128 is spaced apart from the mounting elements 128 adjacent thereto by a gap. Similarly, the plurality of second mounting elements 128 are arranged in an axially spaced apart manner so that each of the second mounting elements 129 is spaced apart from the second mounting elements 129 adjacent thereto by a gap. Each of the plurality of first mounting elements 128 is axially aligned with one of the plurality of second mounting elements 128 and the gaps between the plurality of first mounting elements 128 are aligned with the gaps between the plurality of second mounting elements 129. Thus, an axis that is aligned with the first mounting member 120 and that is transverse to the first axis A-A either intersects one of the first mounting elements 128 and one of the second mounting elements 129 or one of the gaps between adjacent ones of the first mounting elements 128 and one of the gaps between adjacent ones of the second mounting elements 129.

In the exemplified embodiment, each of the plurality of first mounting elements 128 comprises a protrusion 130 and a stopper rib 131. Each of the protrusions 130 and each of the stopper ribs 131 extends from the first side 122 of the body portion 121. Each of the protrusions 130 comprises a front surface 132, a rear surface 133, a top end 134, and a bottom end 135. For each one of the protrusions 130, one of the stopper ribs 131 extends from the front surface 132 of the protrusion 130 at a location that is at or near the top end 134 of the protrusion 130. Thus, the stopper ribs 131 extend directly from the body portion 121 but are also connected directly to one of the protrusions 130. The plurality of second mounting elements 129 have an identical structure as seen in the drawings and thus the description of the plurality of first mounting elements 128 is also applicable to the plurality of second mounting elements 129 (each of which, as denoted in FIG. 4A, comprises a protrusion 142 and a stopper rib 143, with the protrusions 142 each having a front surface 136, a rear surface 137, a top end 138, and a bottom end 139). The first and second mounting members 120, 150 are intended to interact with/engage the mounting bracket 200 to hang the frame 100 from a vertical support surface, and a description of this interaction will be described in more detail below with reference to FIGS. 8A-8D and 9A-9E.

Although in the exemplified embodiment the first and second pluralities of mounting elements 128, 129 are described and illustrated as being protruding elements comprising a protrusion 130, 142 and a stopper rib 131, 143, the invention is not to be so limited in all embodiments. For example, the first and second pluralities of mounting elements 128, 129 may alternatively be openings or apertures formed into the body portion 121 of the mounting member 120 rather than protruding elements. Thus, the important concept is that the first and second pluralities of mounting elements 128, 129, whether they be protruding elements, openings, or some other feature, interact with mounting elements of the mounting bracket 200 to facilitate a coupling therebetween.

Figure 5B:
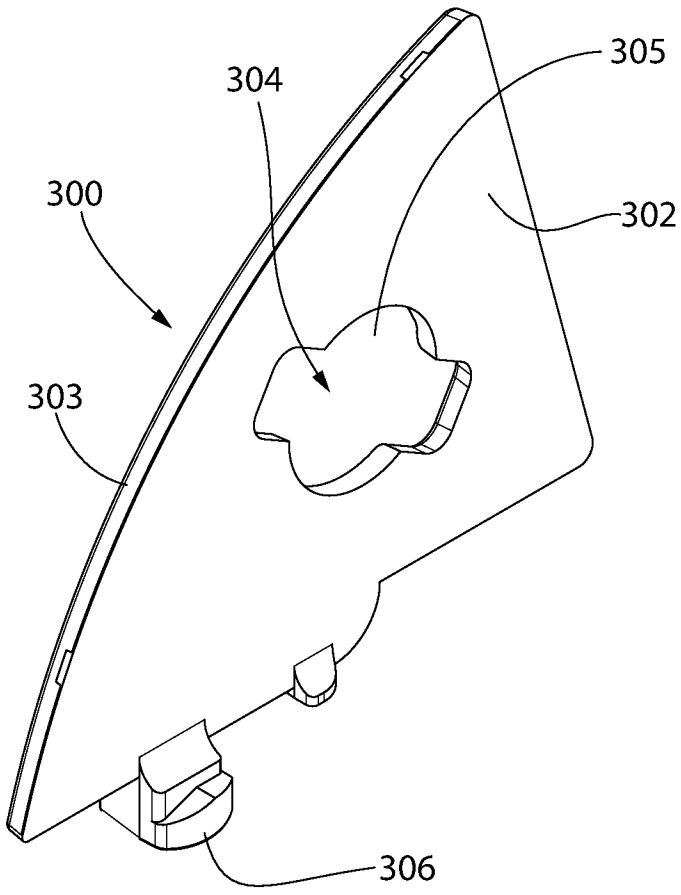
FIG. 5B is a rear top perspective view of the stand of FIG. 1A.
Figure 5A:
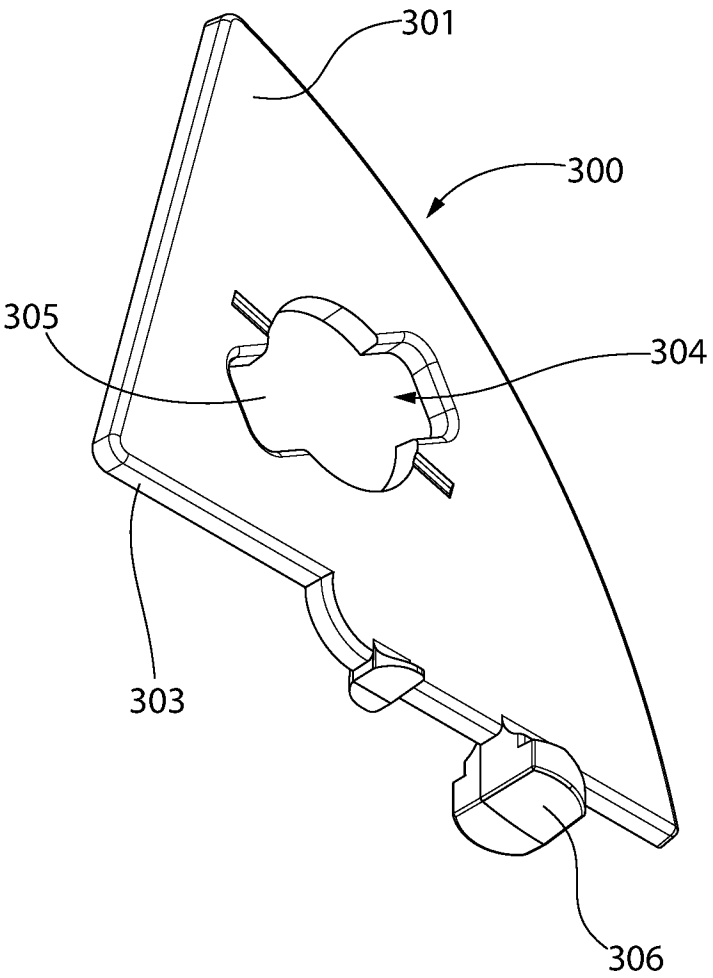
FIG. 5A is a front bottom perspective view of the stand of FIG. 1A.

Referring to FIGS. 5A and 5B, the support stand 300 is illustrated and will be described. The support stand 300 is specifically configured to support the frame 100 on a horizontal surface when the support stand 300 is coupled to the frame 100. The support stand 300 has a front surface 301, a rear surface 302, and an edge 303 extending between the front and rear surfaces 301, 302. Furthermore, the support stand 300 has a coupling element 304 that facilitates coupling the support stand 300 to the frame 100 during storage. In the exemplified embodiment, the coupling element 304 is an aperture 305 that extends through the support stand 300 from the front surface 301 to the rear surface 302. Of course, the coupling element 304 may instead be a protuberance or other feature and this depends on the structure of the portion of the frame 100 to which the coupling element 304 is intended to be coupled, as described below. The support stand 300 also includes one or more attachment elements 306 for coupling the support stand 300 to the frame 100 in a use state so that the support stand 300 can support the frame 100 on a horizontal surface. In the exemplified embodiment, the one or more attachment elements 306 are protuberances that protrude from the edge 303 of the support stand 300, but the attachment elements 306 may instead be apertures that interact with protuberances of the frame 100.

Figure 6A:
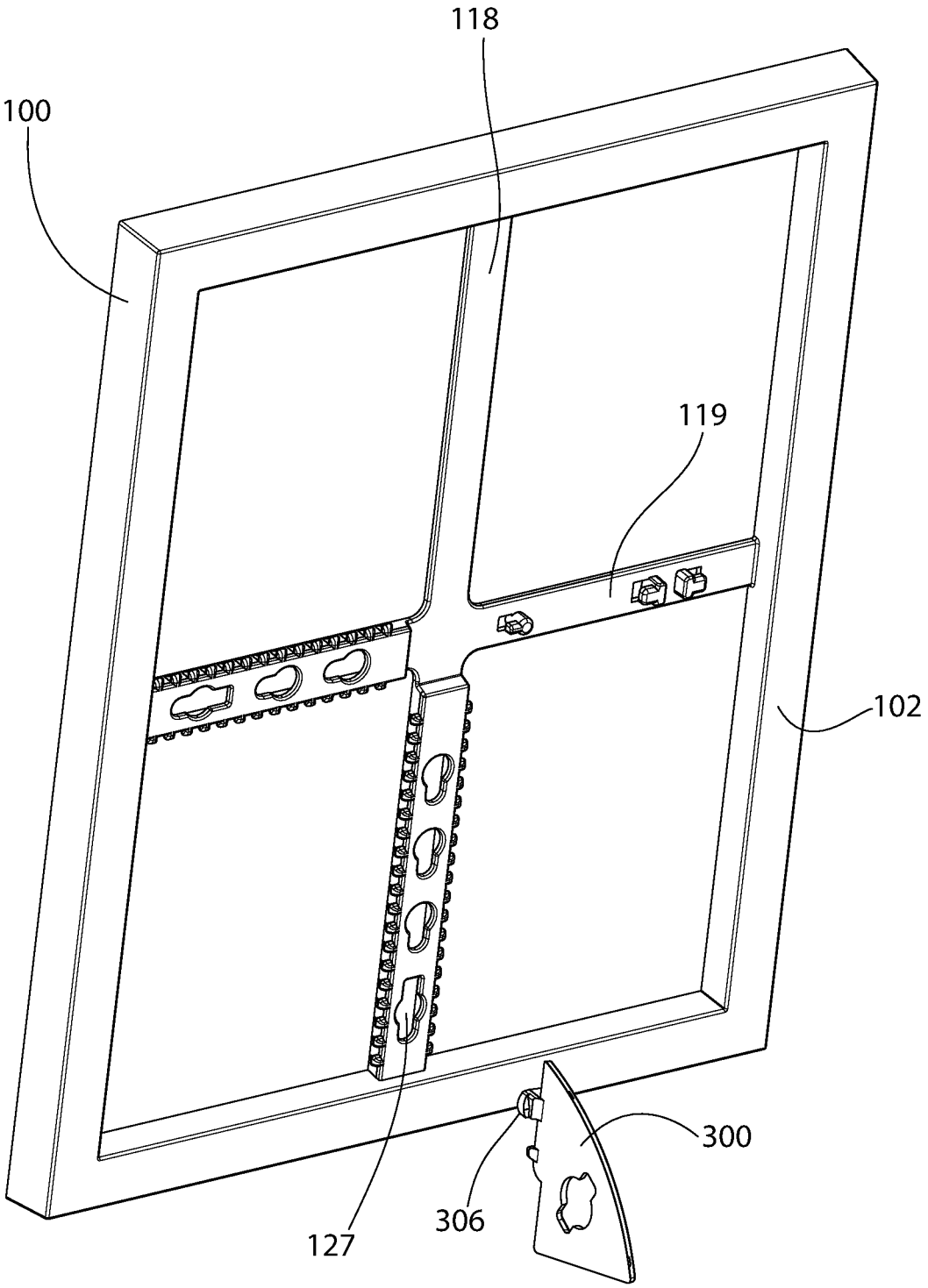
FIGS. 6A and 6B illustrate the manner in which the stand is coupled to the frame to support the frame on a horizontal support surface.
Figure 6B:
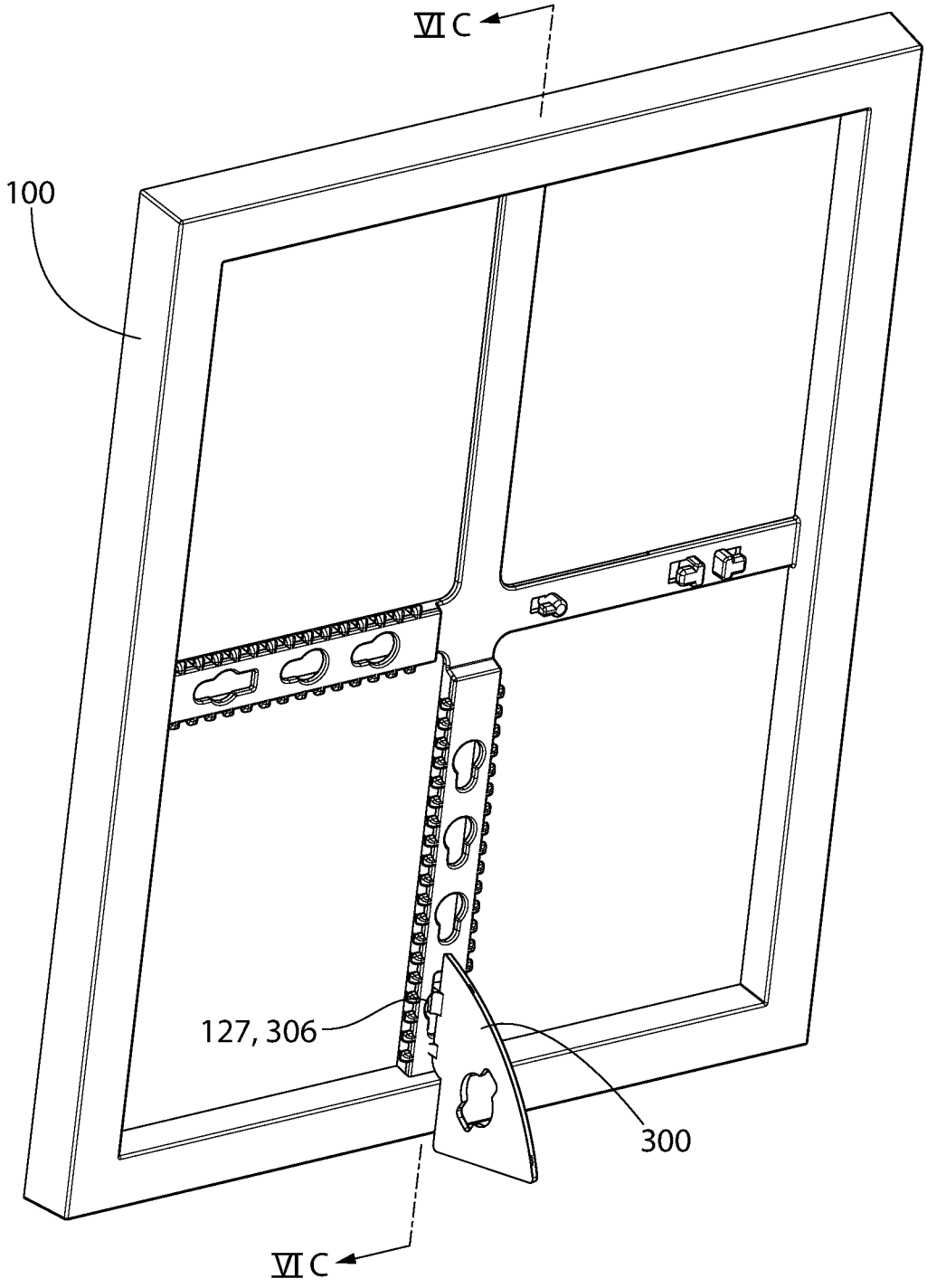
Figure 6C:
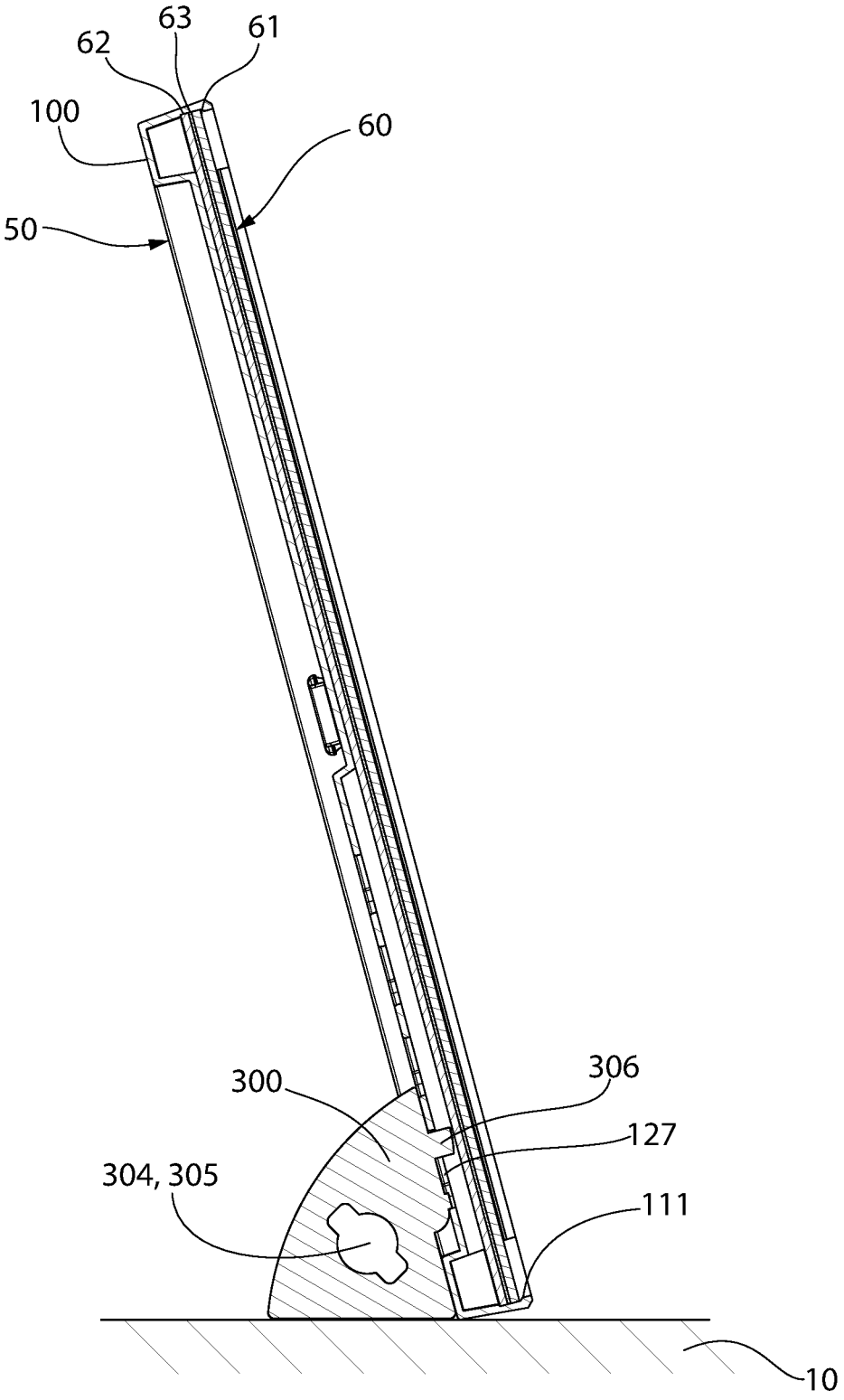
FIG. 6C is a cross-sectional view taken along line VIC-VIC of FIG. 6B with the frame positioned on a horizontal support surface and being supported by the stand.

Turning to FIGS. 6A-6C, the coupling of the support stand 300 to the frame 100 in a use state will be described. As shown in FIG. 6A, first the support stand 300 is placed adjacent to the rear surface 102 of the frame 100 with the one or more attachment elements 306 facing the frame 100. Next, referring to FIG. 6B, the support stand 300 is moved towards the frame 100 until the one or more attachment elements 306 of the support stand 300 engage the additional aperture 127 in the frame 100. In the exemplified embodiment the attachment elements 306 are protuberances and the additional aperture 127 is an opening that receives the attachment elements 306, but in other embodiments the attachment elements 306 may be apertures or openings and the additional aperture 127 may be replaced with a protuberance that is received within the apertures or openings. Once the attachment elements 306 are inserted into the additional aperture 127, the support stand 300 is moved downwardly relative to the frame 100 to lock the support stand 300 to the frame 100. FIG. 6C is a cross-sectional view taken through FIG. 6B illustrating the frame 100 being supported on a horizontal surface 10 by the support stand 300. The support stand 300 supports the frame 100 on the horizontal surface 10 at a desirable viewing angle as shown in FIG. 6C.

Figure 7A:
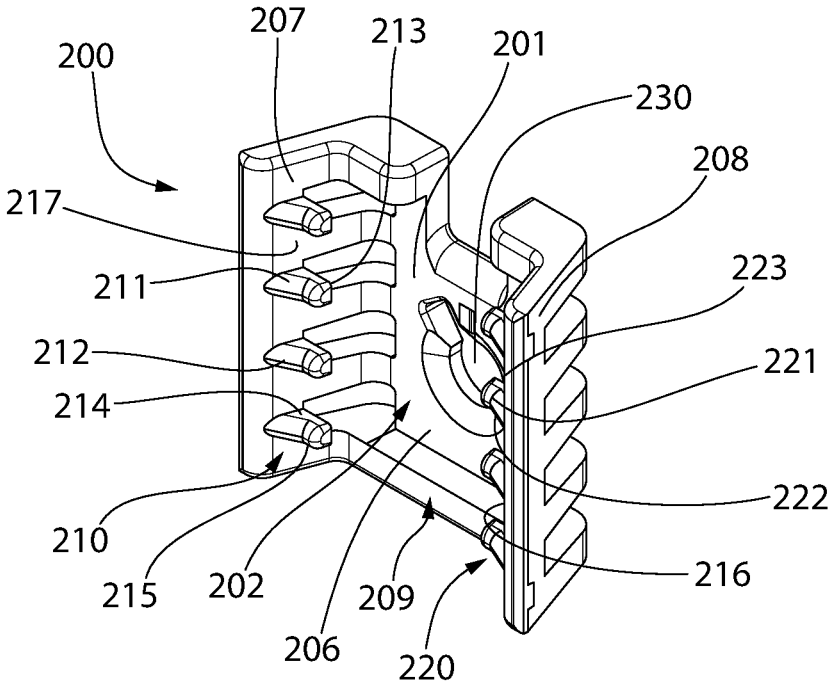
FIG. 7A is a rear perspective view of the mounting bracket of the hanging assembly of the frame apparatus of FIG. 1A.
Figure 7B:
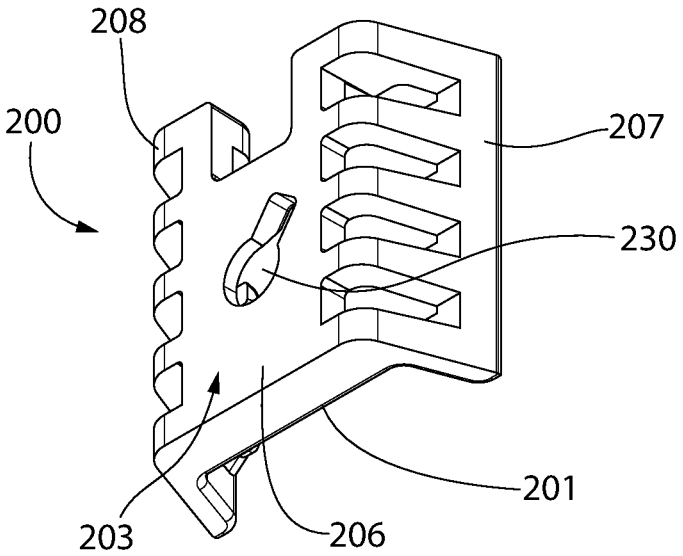
FIG. 7B is a front perspective view of the mounting bracket of the hanging assembly of the frame apparatus of FIG. 1A.
Figure 7C:
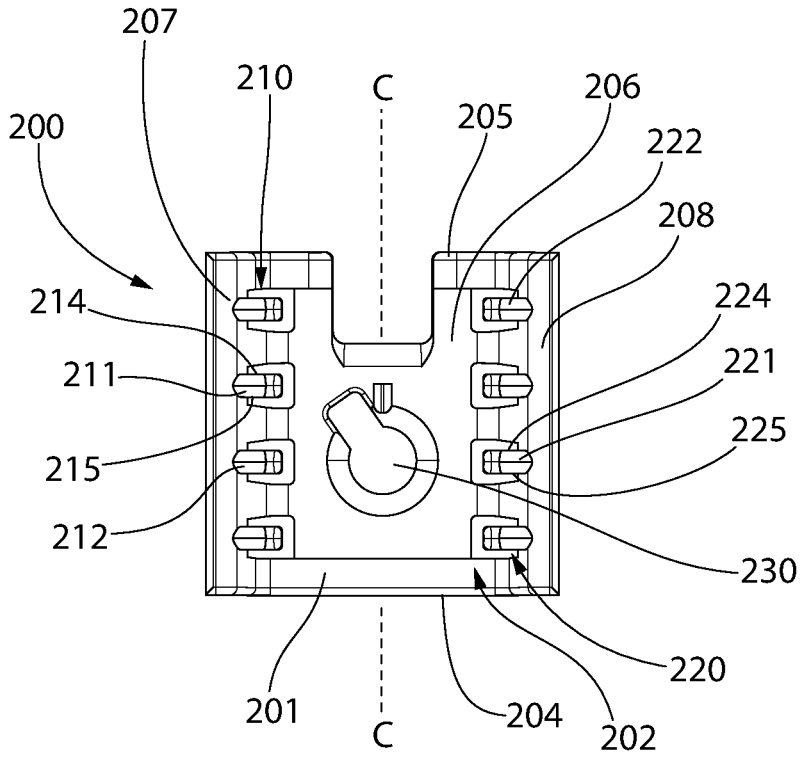
FIG. 7C is a rear view of the mounting bracket of the mounting bracket of the hanging assembly of the frame apparatus of FIG. 1A.

Referring to FIGS. 7A-7C, the mounting bracket 200 will be described. The mounting bracket generally comprises a body 201, a one or more third mounting elements 210, and one or more fourth mounting elements 220. The body 201 extends from a first end 204 to a second end 205 along a third axis C-C. In the exemplified embodiment, the body 201 has a generally U-shape such that it includes a main portion 206, a first sidewall 207, and a second sidewall 208. The main portion 206 has a front surface 202 that forms a floor and a rear surface 203 opposite the front surface 202. Each of the first and second sidewalls 207, 208 extends from the front surface 202 of the main portion 206 on opposite sides of the third axis C-C to form the generally U-shape of the body 201 of the mounting bracket 200. The floor and the inner surface of the first and second sidewalls 207, 208 collectively define a cavity 209 of the mounting bracket 200 that is configured to receive a portion of one of the first and second mounting members 120, 150.

The one or more third mounting elements 210 extend from an inner surface 216 of the first sidewall 207 in a direction towards the second sidewall 208 (and towards the third axis C-C). In the exemplified embodiment, there are four of the third mounting elements 210. However, the invention is not to be so limited in all embodiments and there could be as few as one of the third mounting elements 210 in some embodiments and there could be more than four of the third mounting elements 210 in other embodiments. That said, generally the number of third mounting elements 210 is less than half of the number of the first and second mounting elements 128, 129 of the first mounting member 120. The one or more fourth mounting elements 220 extend from an inner surface 217 of the second sidewall 208 in a direction towards the first sidewall 207 and towards the third axis C-C. The number of the fourth mounting elements 220 is generally the same as the number of the first mounting elements 210.

In the exemplified embodiment, the third mounting elements 210 comprises a protrusion 211 having a front surface 212, a rear surface 213, a top end 214 and a bottom end 215. The protrusions 211 are arranged in an axially spaced apart manner such that gaps exist between adjacent ones of the protrusions 211. Furthermore, each of the fourth mounting elements 220 comprises a protrusion 221 having a front surface 222, a rear surface 223, a top end 224, and a bottom end 225. The protrusions 221 are arranged in an axially spaced apart manner such that gaps exist between adjacent ones of the protrusions.

Of course, although the one or more third and fourth mounting elements 210, 220 are illustrated and described herein as being protrusions, in other embodiments the third and fourth mounting elements 210, 220 may be openings or apertures formed into the body 201. Regardless of the specific structure of the third and fourth mounting elements 210, 220 of the mounting bracket 200, the third and fourth mounting elements 210, 220 are configured in such a manner that they interact with/engage the first and second mounting elements 128, 129 of the first mounting member 120 (or the similar mounting elements of the second mounting member 150 depending on the orientation at which the frame 100 is to be hung) to hang the frame 100 from a support surface.

The mounting bracket 200 also comprises an aperture 230 that facilitates coupling the mounting bracket 200 to the frame 100 in a storage position, as described briefly below with reference to FIGS. 10A-10C. However, the aperture 230 may be replaced with a protuberance or other feature depending on the structure of the specific feature of the frame 100 which the mounting bracket 200 is configured to mount to in the storage position.

FIGS. 8A-8D, and then also FIGS. 9A-9D, illustrate the manner in which the mounting bracket 200 is coupled to the first mounting member 120. A similar process can be used to couple the mounting bracket 200 to the second mounting member 150. In the exemplified embodiment, the first and second mounting members 120, 150 are integral with the frame 100 such that the first and second mounting members 120, 150 need not be separately coupled or attached to the frame 100. However, in other embodiments, such as those described below with reference to FIGS. 11A-12B, the first and second mounting members 120, 150 may be separate components relative to the frame 100 and in such embodiments the first and second mounting members 120, 150 must be coupled to the frame 100 to facilitate hanging the frame 100 from a support surface using the hanging assembly 190.

Referring to FIGS. 8A-8D, the mounting bracket 200 is first mounted to a support surface (such as a wall) using a screw or other piece of hardware. Next, the frame 100 with the first and/or second mounting members 120, 150 either integrally formed therewith or otherwise coupled thereto is moved towards the mounting bracket 200 with the first mounting member 120 aligned with the mounting bracket 200. The frame 100 continues to be moved until the first and second mounting elements 128, 129 of the first mounting member 120 engage/interact with the third and fourth mounting elements 210, 220 of the mounting bracket 200. Just prior to this engagement, a subset of the first mounting elements 128 passes through the gaps between the one or more third mounting elements 210 while the third mounting elements 210 pass through the gaps between the first mounting elements 128 and a subset of the second mounting elements 129 pass through the gaps between the one or more fourth mounting elements 220 while the fourth mounting elements 220 pass through the gaps between the second mounting elements 129.

Figure 8A:
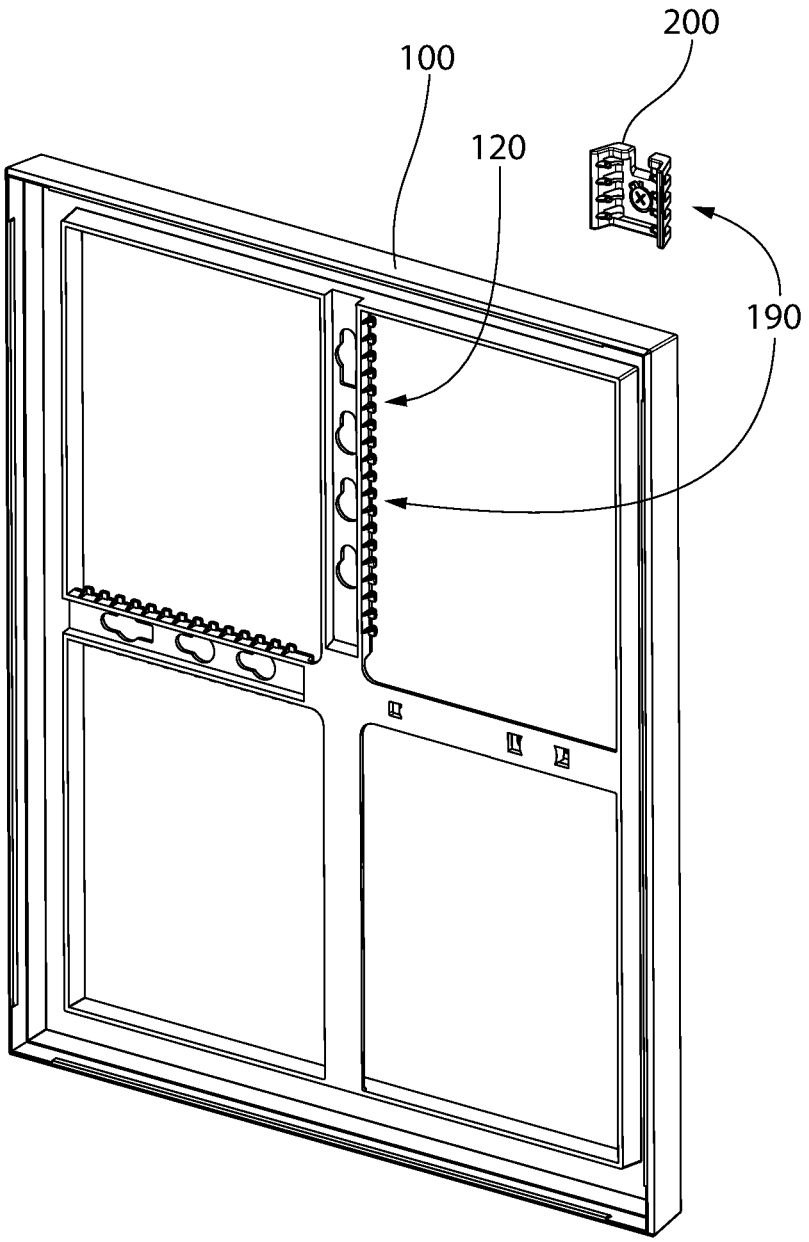
FIGS. 8A and 8B illustrate the manner in which the mounting bracket of the hanging assembly is attached to the mounting member of the hanging assembly.
Figure 8B:
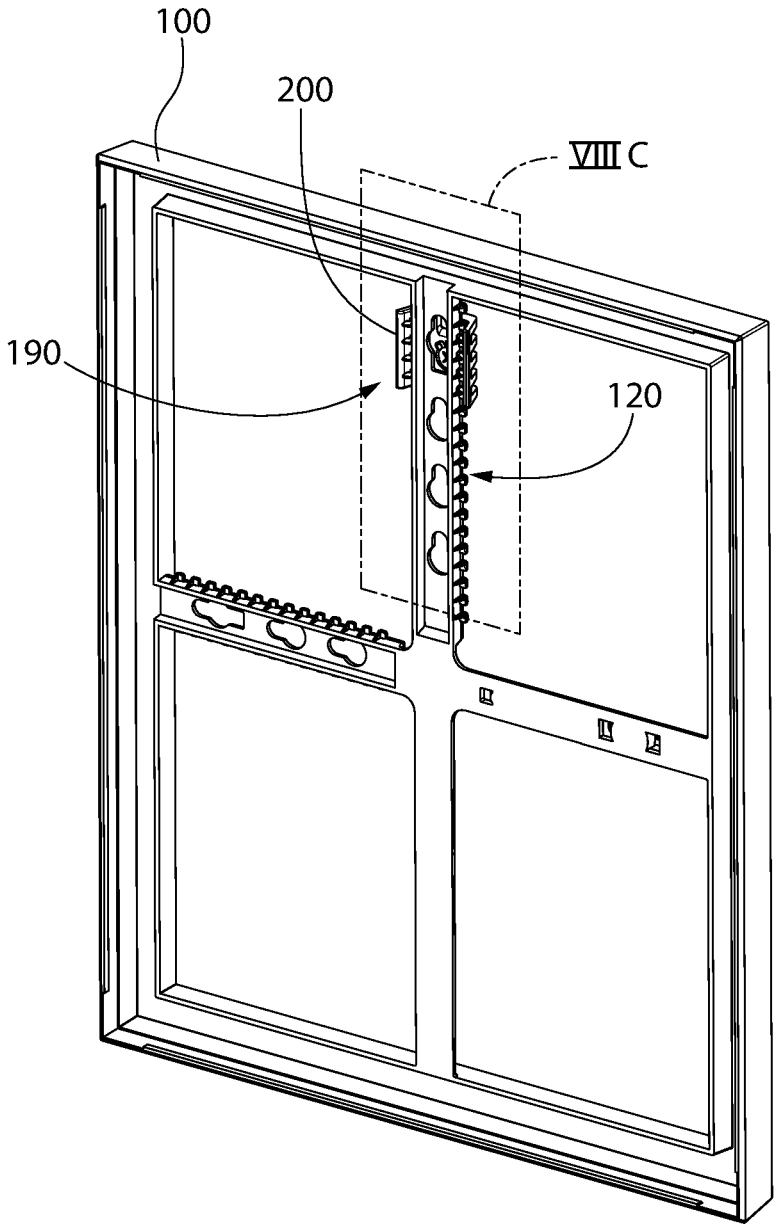
Figure 8C:
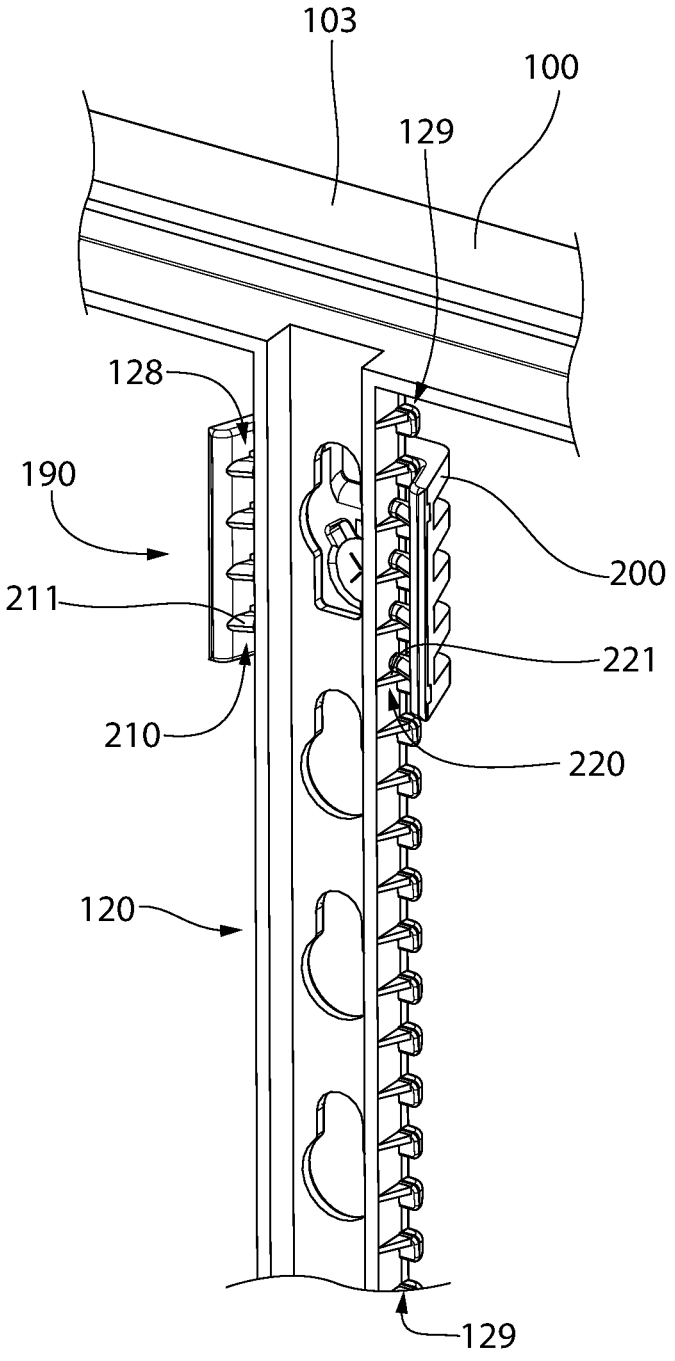
FIGS. 8C and 8D are close-up perspective and front views of area VIIIC of FIG. 8B.
Figure 8D:
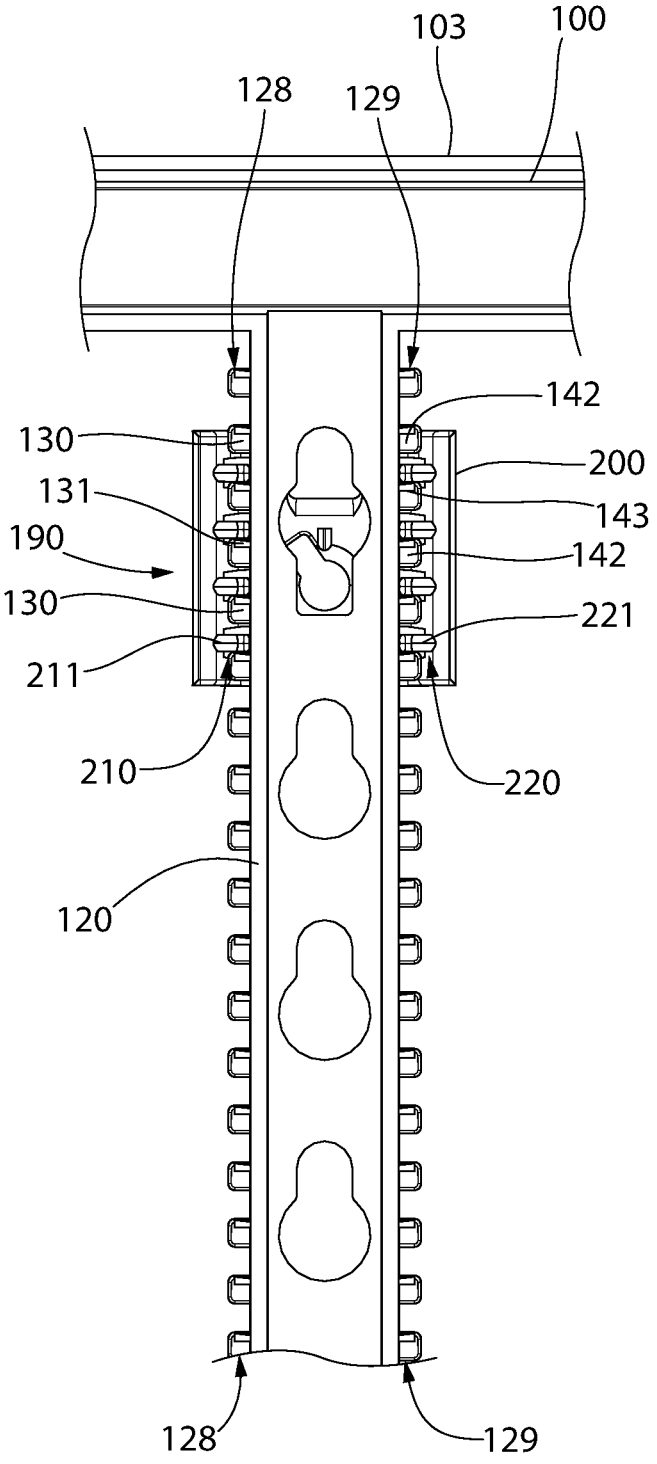

Referring specifically to FIGS. 8C and 8D, the hanging height of the frame 100 can be changed without moving the location of the mounting bracket 200 on the support surface. Specifically, the hanging height of the frame 100 can be changed simply by changing which of the first and second mounting elements 128, 129 of the first mounting member 120 form the first and second subsets of the first and second mounting elements 128, 129 that engage/interact with the third and fourth mounting elements 210, 220 of the mounting bracket 200. Thus, the frame 100 can be hung higher by using ones of the first and second mounting elements 128, 129 that are located further from the outer surface 103 of the frame 100 to interact with the first and second pluralities of mounting elements 210, 220 of the mounting bracket 200 and lower by using ones of the first and second mounting elements 128, 129 that are located closer to the outer surface 103 of the frame 100 as the first and second subsets.

Figure 9A:
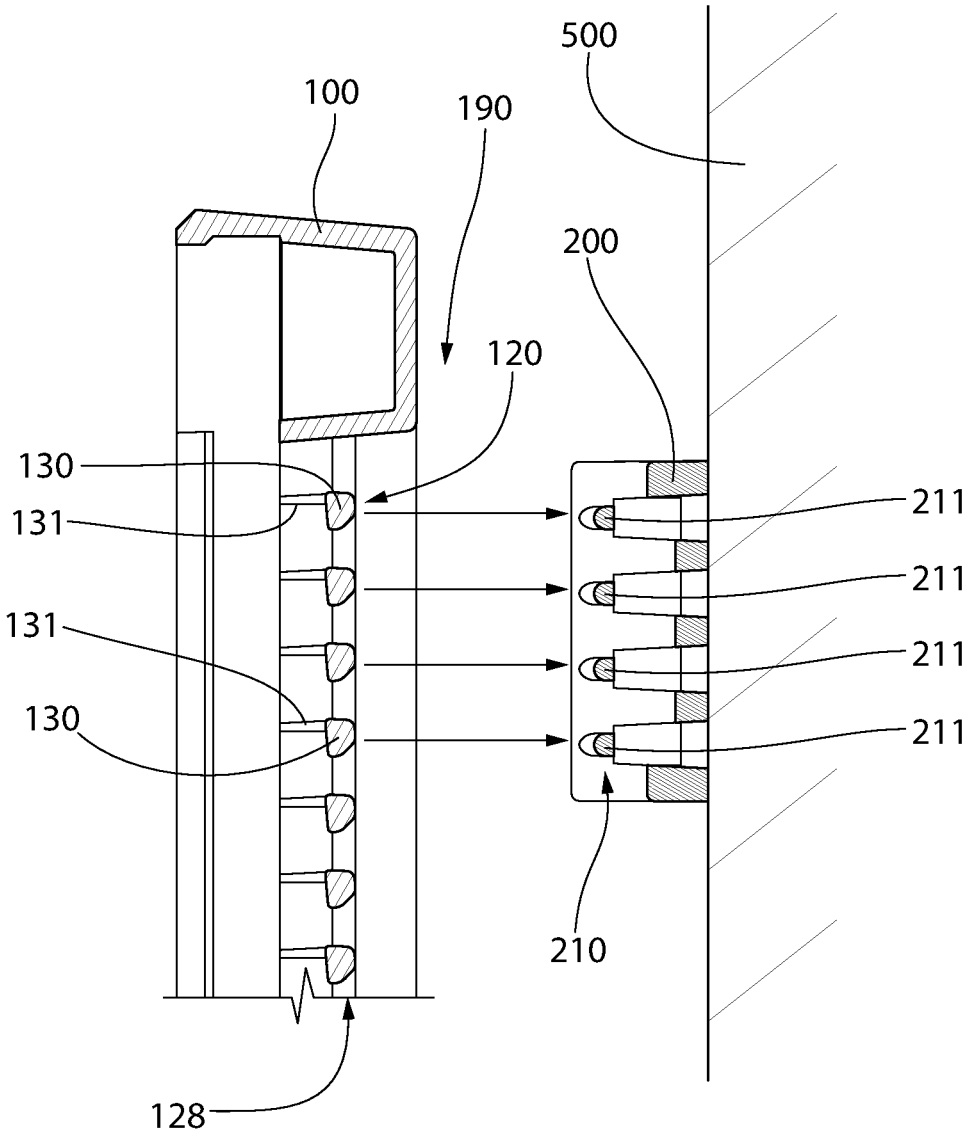
FIGS. 9A-9D are schematic cross-sectional views that illustrate the manner in which the mounting member can be coupled to the mounting bracket with the mounting bracket mounted to a vertical surface in order to hang the frame from the vertical surface.

FIGS. 9A-9D illustrate a close-up schematic view of the process of coupling the frame 100 to the mounting bracket 200. As shown in FIG. 9A, the mounting bracket 200 is coupled to a support surface 500 (with a screw, nail, or other piece of hardware) and the frame 100 is held so that the first mounting member 120 is aligned with the mounting bracket 200. The frame 100 can be moved upwardly and downwardly while keeping the first mounting member 120 aligned with the mounting bracket 200 to determine the appropriate or desired hanging height for the frame 100.

Figure 9B:
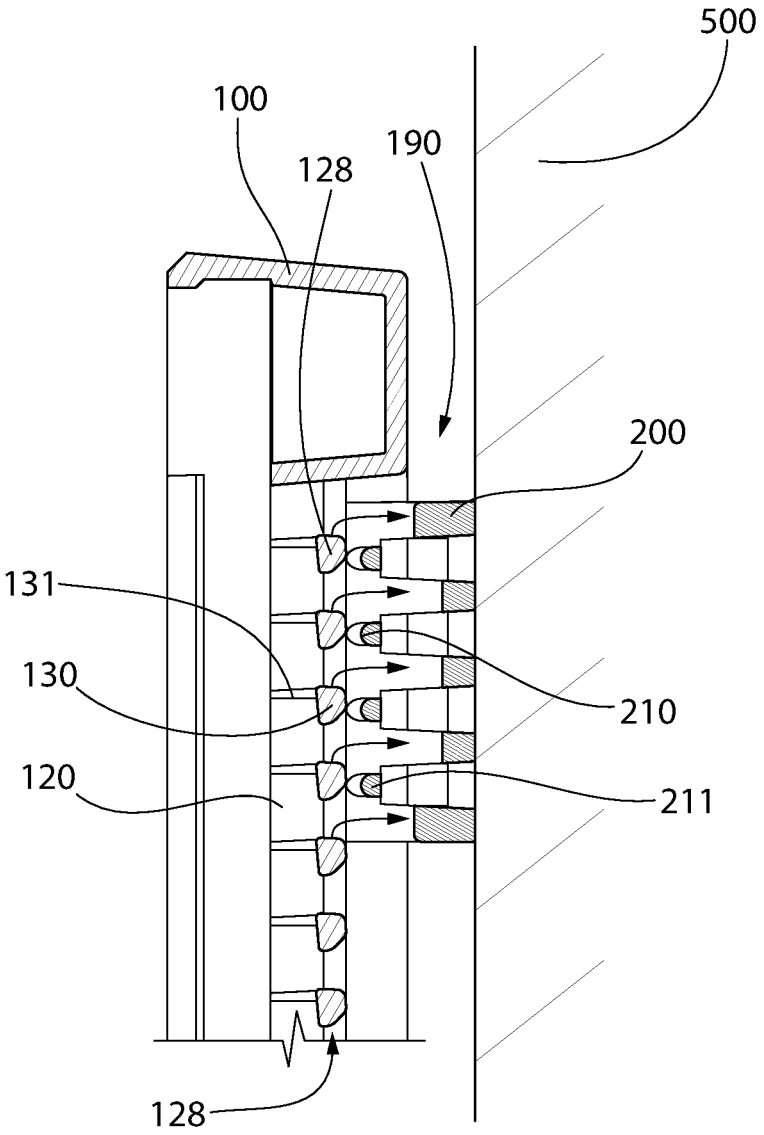

Referring to FIG. 9B, once the frame 100 is positioned at its desired hanging height, the frame 100 is moved towards the mounting bracket 200 until a subset of the first and second mounting elements 128, 129 of the first mounting member 120 are adjacent to the third and fourth mounting elements 210, 220 of the mounting bracket 200, respectively (only the first mounting elements 128 of the first mounting member and the third mounting elements 210 of the mounting bracket 200 are shown, but the same is occurring with the second mounting elements 129 of the mounting member 120 and the fourth mounting elements 220 of the mounting bracket 200).

Figure 9C:
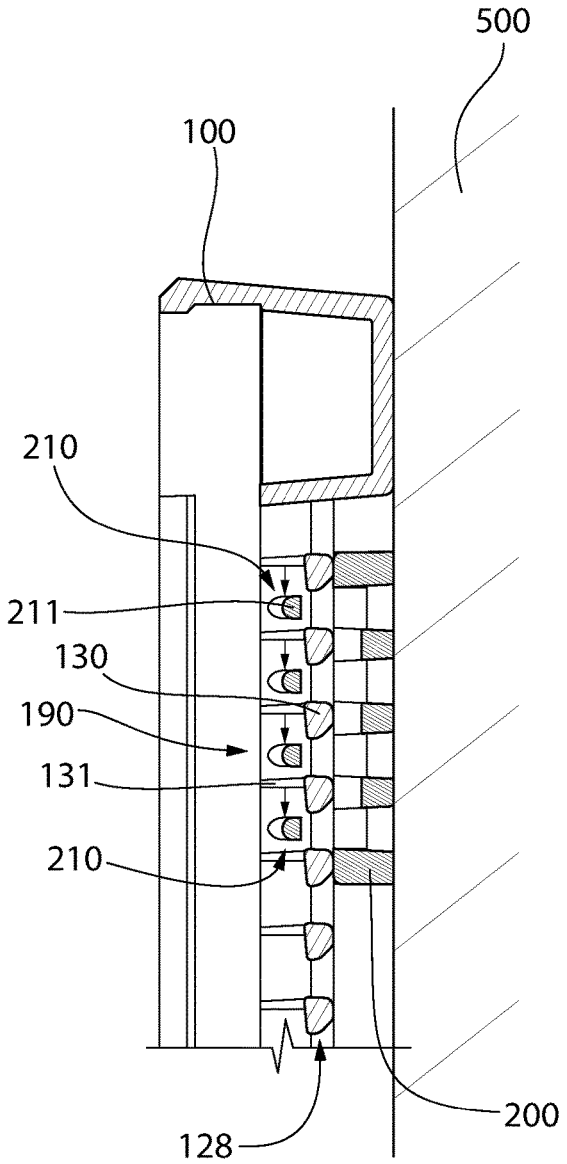

Next, referring to FIG. 9C, the frame 100 is continued to be moved towards the support surface 500 until the first and second mounting elements 128, 129 of the first mounting member 120 pass into and through the gaps between the third and fourth mounting elements 210, 220 of the mounting bracket 200. Simultaneously, the third and fourth mounting elements 210, 220 of the mounting bracket 200 pass into and through the gaps between the first and second mounting elements 128, 129 of the first mounting member 120.

Figure 9D:
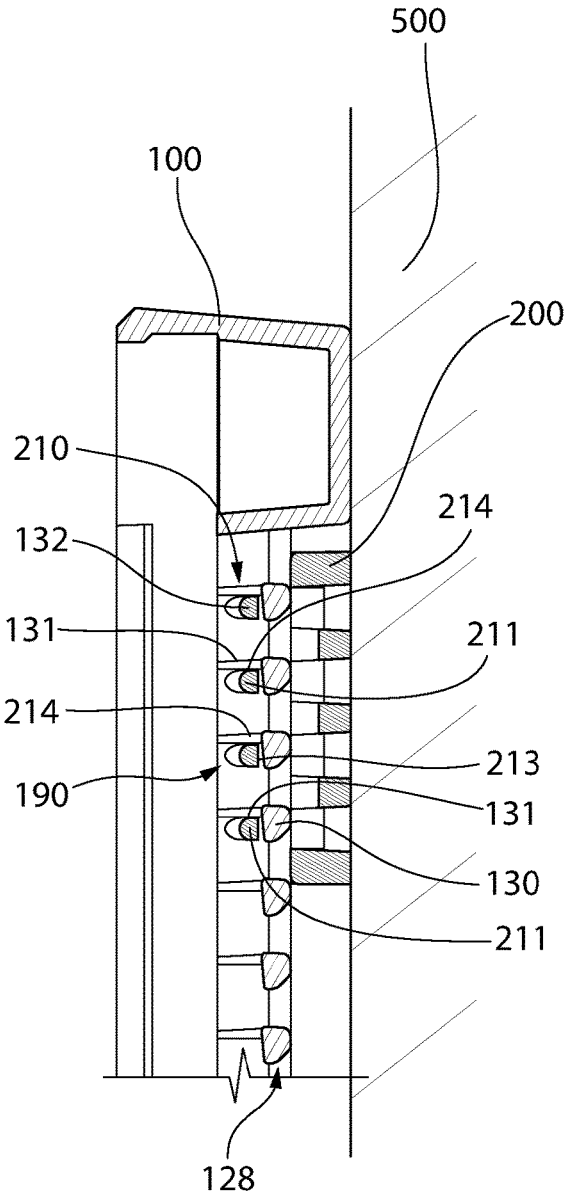

Finally, referring to FIG. 9D, the frame 100 is lowered downwardly relative to the mounting bracket 200, which is maintained stationary on the support surface 500 due to it being mounted thereto by a screw or the like, until the stopper ribs 131, 133 of the first and second pluralities of mounting elements 128, 129 of the first mounting member 120 rest atop the top surfaces 214, 224 of the tabs 211, 221 of the first and second mounting elements 210, 220 of the mounting bracket 200. This downward lowering of the frame 100 may be achieved via gravity or via a user applying a downward force onto the frame 100. In this position, the frame 100 cannot be readily detached from the mounting bracket 200 due to front-to-back engagement between the protrusions 211, 221 of the mounting bracket 200 and the protrusions 130, 142 of the first and second mounting elements 128, 129 of the first mounting member 120.

Specifically, when fully installed, the front surfaces 132 of the protrusions 130 of the first mounting elements 128 of the first mounting member 120 face, and potentially abut, the rear surfaces 213 of the protrusions 211 of the third mounting elements 210 of the mounting bracket 200. Furthermore, although not shown in these figures, the front surfaces 136 of the protrusions 142 of the second mounting elements 129 face, and potentially abut, the rear surfaces 223 of the protrusions 221 of the fourth mounting elements 220. As a result, the frame 100 with the first and second mounting members 120, 150 coupled thereto or formed integrally therewith cannot be pulled away from the support surface 500 in a direction perpendicular to the support surface 500 due to the engagement between the protrusions 130, 142 of the first and second mounting members 120, 150 and the protrusions 211, 221 of the mounting bracket 200. Furthermore, because the stopper ribs 131 143 of the first and second mounting elements 128, 129 rest atop the top ends 214, 224 of the protrusions 211, 222 of the third and fourth mounting elements 210, 220 of the mounting bracket 200, the frame 100 will not be pulled off of the mounting bracket 200 via gravity. Rather, the only way to remove the frame 100 from the support surface 500 is to life the frame 100 upwardly so that the protrusions 130, 142 of the first and second mounting members 120, 150 are aligned with the gaps between the third mounting members 210 and between the fourth mounting members 220 and to then pull the frame 100 away from the support surface 500 (i.e., reverse the steps from FIG. 9D to FIG. 9A).

Because there are more of the first and second mounting elements 128, 129 than there are of the third and fourth mounting elements 210, 220, different subsets of the first and second mounting elements 128, 129 may be engaged with the third and fourth mounting elements 210, 220 to adjust the hanging height of the frame 100. In the exemplified embodiment, there are nineteen of the first mounting elements 128, nineteen of the second mounting elements 129, four of the third mounting elements 210, and four of the fourth mounting elements 220. However, these are merely exemplary numbers and can be modified readily while ensuring that there are a greater number of the first and second mounting elements 128, 129 than the third and fourth mounting elements 210, 220 to maintain the adjustability function described herein. In one embodiment, there are at least three times more of the first mounting elements 128 than there are of the third mounting elements 210 and at least three times more of the second mounting elements 129 than there are of the fourth mounting elements 220. Of course, in other embodiments there could be more of the third and fourth mounting elements 210, 220 than of the first and second mounting elements 128, 129, which would still enable the hanging assembly 190 to have an adjustability function. In the embodiment shown in FIG. 9D, the top-most four of the first and second mounting elements 128, 129 form the first and second subsets of the first and second mounting elements 128, 129 that are engaged with the third and fourth mounting elements 210, 220 of the mounting bracket 200. The frame 100 can be hung higher on the support surface 500 by changing which of the first and second mounting elements 128, 129 form the first and second subsets.

Figure 10A:
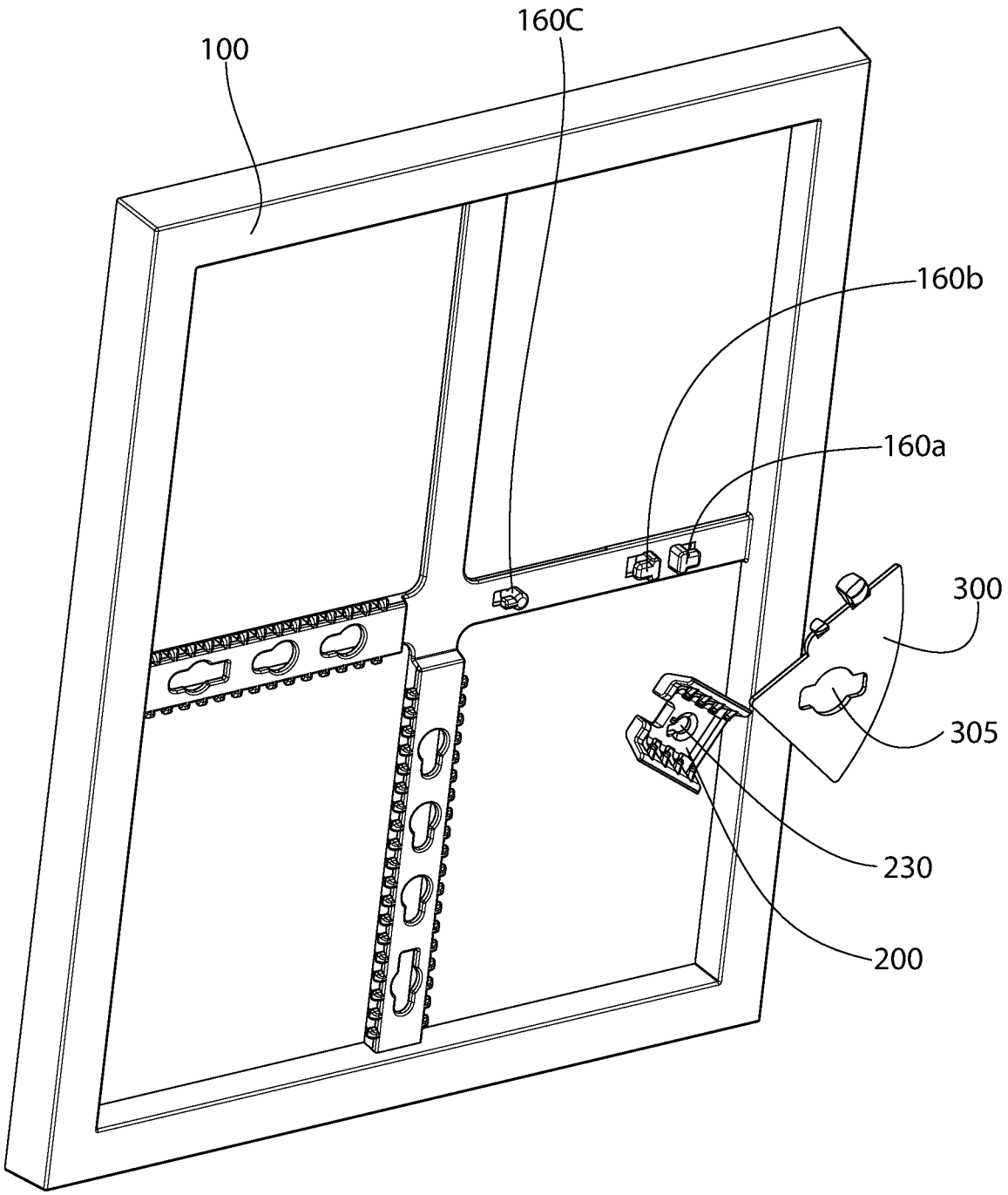
FIGS. 10A-10C illustrate the manner in which the stand and the mounting bracket are coupled to the frame for storage.
Figure 10B:
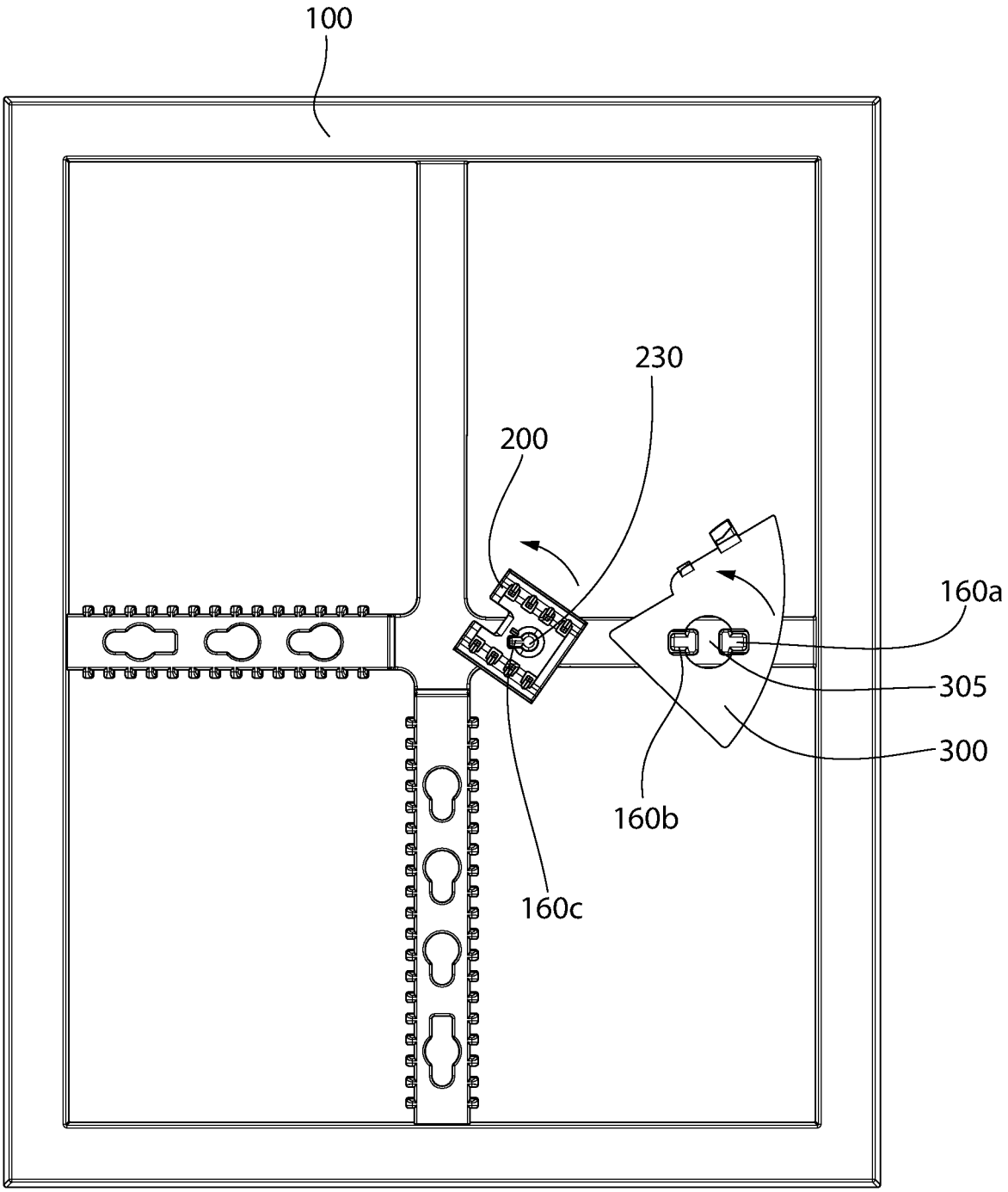
Figure 10C:
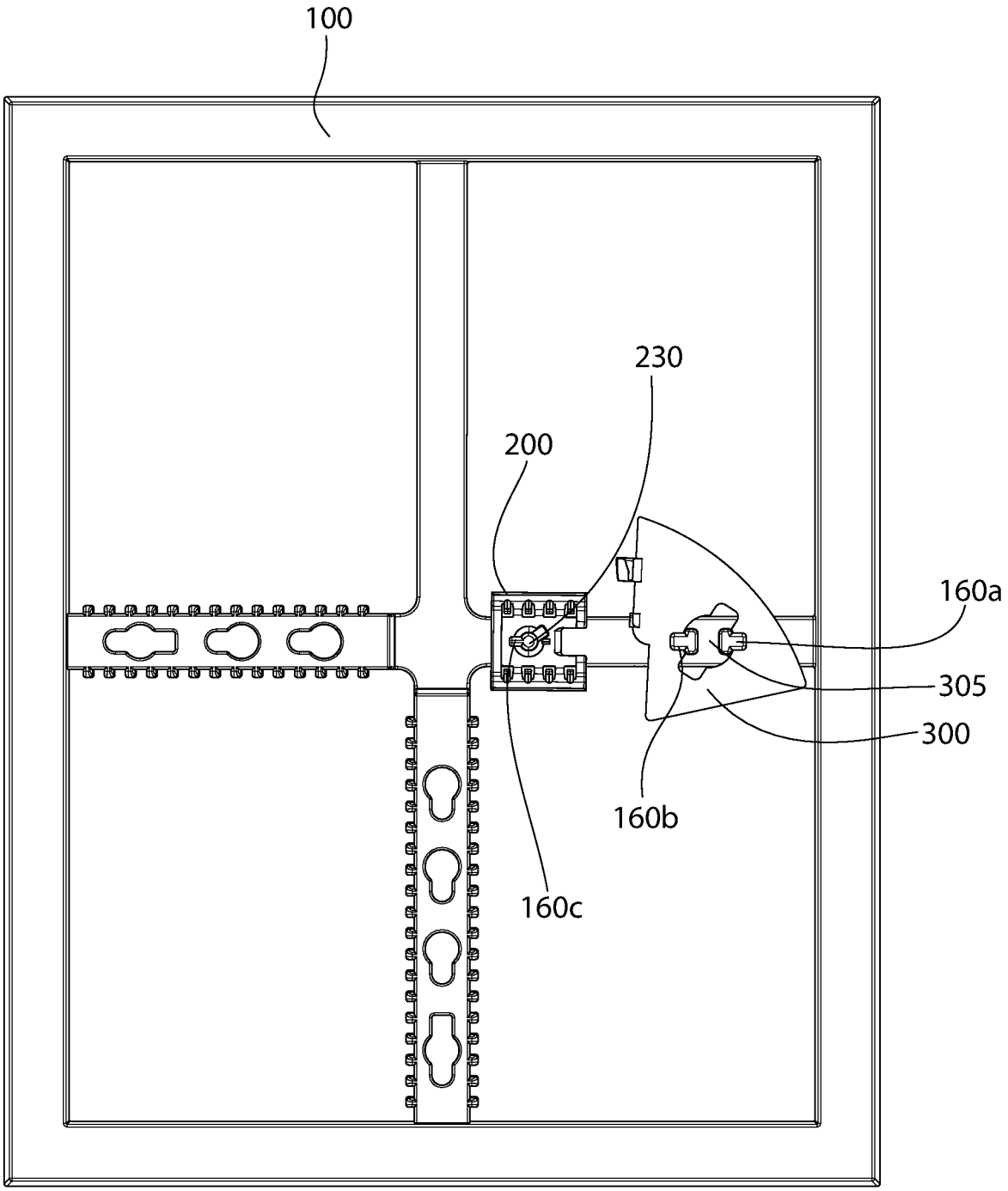

Referring now to FIGS. 10A-10C, coupling of the mounting bracket 200 and the support stand 300 to the frame 100 for storage will be briefly described. The frame 100 comprises a plurality of storage protuberances 160*a*-160*c* for securing the mounting bracket 200 and the support stand 300 to the frame 100 for storage. Specifically, the plurality of storage protuberances 160*a-c* comprises first and second storage protuberances 160*a-b* that are used for securing the support stand 300 to the frame 100 and a third storage protuberance 160*c* that is used for securing the mounting bracket 200 to the frame 100.

To mount the support stand 300 to the frame 100 for storage, the support stand 300 is moved towards the frame 100 until the first and second storage protuberances 160*a-b* extend into the aperture 305 of the support stand 300. Next, the support stand 300 is rotated relative to the frame 100 to lock the support stand 300 to the frame 100. Similarly, to mount the mounting bracket 200 to the frame 100 for storage, the mounting bracket 200 is moved towards the frame 100 until the third storage protuberance 160*c* extends into the aperture 230 of the mounting bracket 200. Next, the mounting bracket 200 is rotated relative to the frame 100 to lock the mounting bracket 200 to the frame 100. Thus, if the support stand 300 is being used to support the frame 100 on a horizontal support surface, the mounting bracket 200 may be mounted to the third storage protuberance 160*c* and if the mounting bracket 200 is being used to support the frame 100 on a vertical support surface, the support stand 300 may be mounted to the first and second storage protuberances 160*a-b*. Furthermore, if neither of the mounting bracket 200 or the support stand 300 is being used to support the frame 100 (for example, because the hanging apertures 126 are being used for this purpose), both of the mounting bracket 200 and the support stand 300 may be simultaneously mounted to the storage protuberances 160*a-c*.

Of course, although the mounting bracket 200 and the support stand 300 are illustrated and described as having apertures that mate with storage protuberances of the frame 100, the opposite configuration is possible in alternative embodiments. Specifically, the mounting bracket 200 and the support stand 300 may comprise protuberances that engage storage apertures in the frame 100 to mount the mounting bracket 200 and/or the support stand 300 to the frame 100 for storage. Thus, in some embodiments the features used for mounting the mounting bracket 200 and the support stand 300 to the frame 100 may simply be referred to as coupling elements, it being understood that such coupling elements may include either protuberances or apertures on either the frame 100 or the mounting bracket 200 and support stand 300.

Figure 11A:
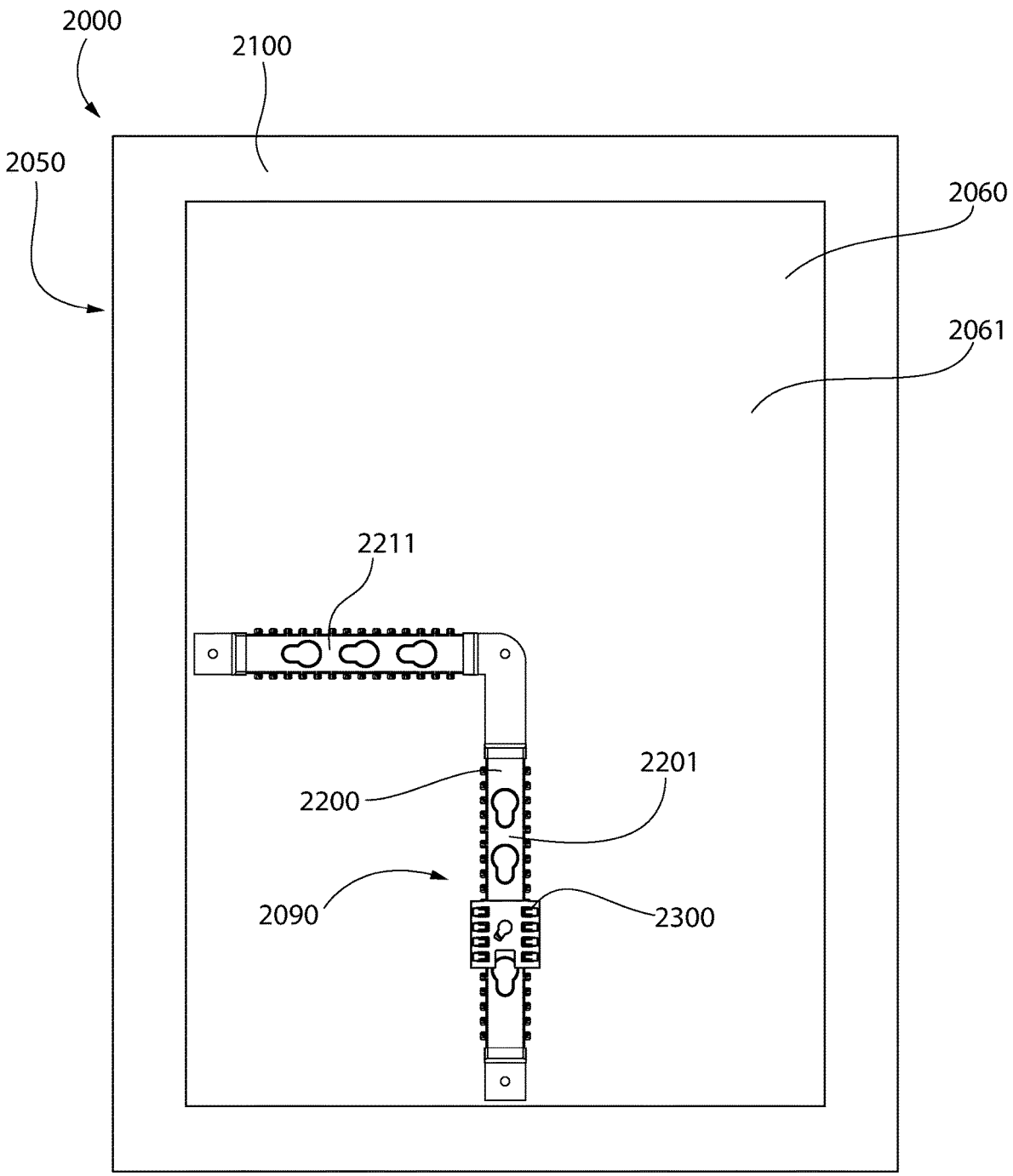
FIG. 11A is a rear view of a frame with a hanging assembly coupled to a backer panel that is retained by the frame, in accordance with another embodiment of the present invention.
Figure 11B:
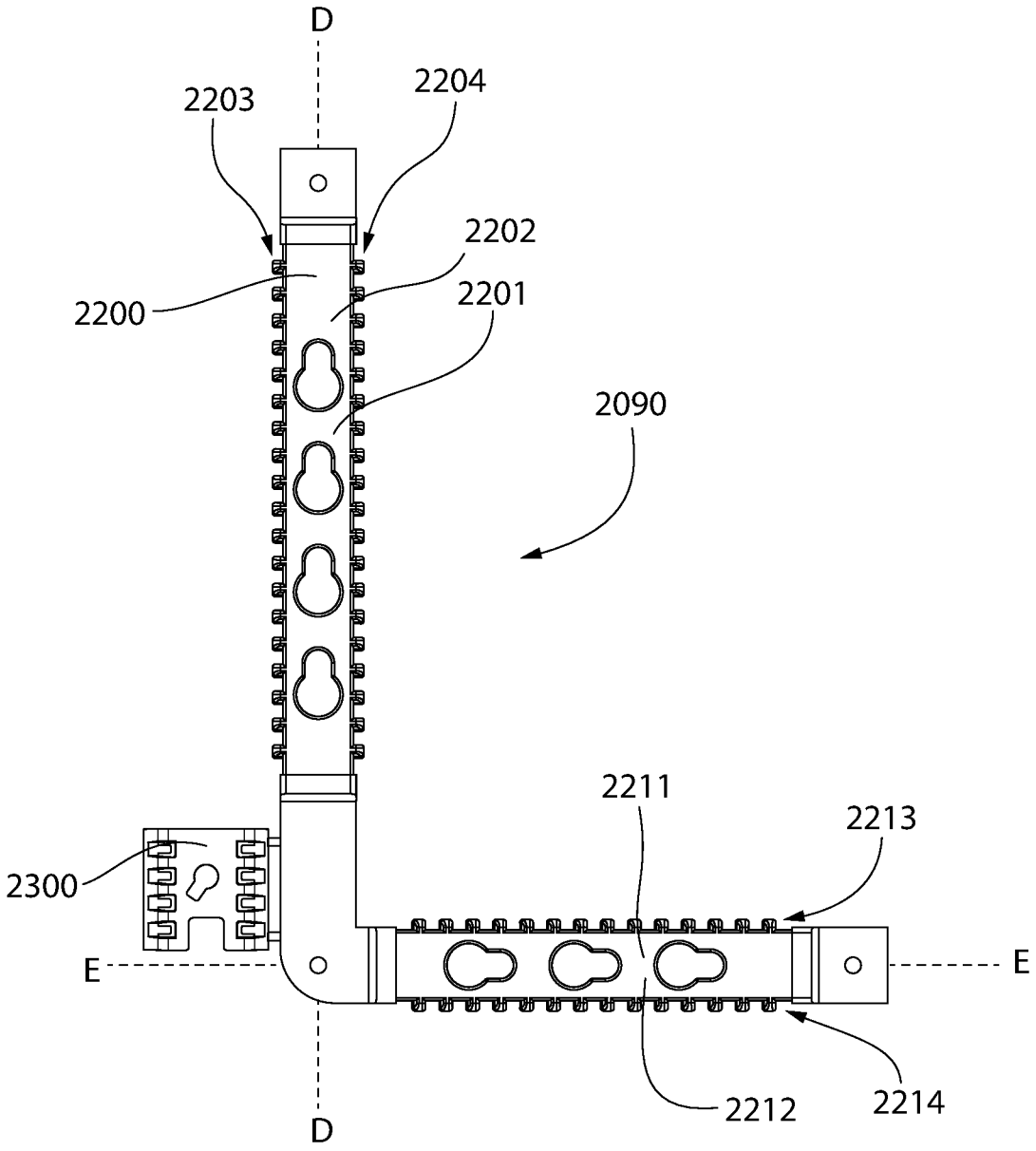
FIG. 11B is a front view of the hanging assembly of FIG. 11A.

Referring to FIGS. 11A and 11B, another embodiment of a frame apparatus 2000 is illustrated in accordance with an embodiment of the present invention. The frame apparatus 2000 generally comprises a support structure 2050 that comprises a frame 2100 and a stack 2060 retained by the frame 1200 and a hanging assembly 2090 that is coupled to the support structure 2050. The hanging assembly 2090 generally comprises a mounting member 2200 and a mounting bracket 2300. The mounting member 2020 is generally configured to be coupled to the support structure 2050 and the mounting bracket 2300 is generally configured to be coupled to a support surface. The mounting member 2200 can then be coupled or mounted to the mounting bracket 2300 to hang the support structure 2050 from the support surface. The main difference in this embodiment as compared to the one previously described is that the mounting member 2200 is not integrally formed with the frame 2100. Rather, in this embodiment the mounting member 2200 is manufactured separately from the frame 2100 and is then coupled to the support structure 2050.

Referring to FIG. 11B, in the exemplified embodiment the hanging assembly 2090 is an integral construction that includes the mounting member 2200 and the mounting bracket 2300 integrally formed therewith. Prior to use, the mounting bracket 2300 can be detached from the mounting member 2200 so that it can be coupled to a support surface. Of course, in other embodiments the mounting member 2200 and the mounting bracket 2300 may be separately formed rather than formed as a unitary structure. The mounting member 2200 comprises a first portion 2201 that extends along a first axis D-D and a second portion 2211 that extends along a second axis E-E.

The first portion 2201 comprises a body portion 2202 that is elongated along the first axis D-D, a plurality of first mounting elements 2203 extending from the body portion 2202 on a first side of the first axis D-D, and a plurality of second mounting elements 2204 extending from the body portion 2202 on a second side of the first axis D-D. The second portion 2211 comprises a body portion 2212 that is elongated along the second axis E-E, a plurality of first mounting elements 2213 extending from the body portion 2212 on a first side of the second axis E-E, and a plurality of second mounting elements 2214 extending from the body portion 2212 on a second side of the second axis E-E. The structural details of the mounting elements 2203, 2204, 2213, 2214 are identical to that which was described above for the mounting elements 128, 129. Therefore, these structural details will not be repeated herein in the interest of brevity, it being understood that the description of the mounting elements 128, 129 is applicable to the mounting elements 2203, 2204, 2213, 2214.

The mounting bracket 2300 is identical structurally to the mounting bracket 200. Therefore, the description of the mounting bracket 200 provided above is applicable to the mounting bracket 2300, and those details will not be provided herein in the interest of brevity.

In this embodiment, the hanging assembly 190 is manufactured as a stand-alone component and the mounting member 2200 is coupled to the support structure 2050 so that it can be used to hang the support structure 2050 from a support surface such as a wall or the like. In this embodiment, the mounting member 2200 comprises a singular, unitary member having an L shape so that it includes the first portion 2201 and the second portion 2211. The mounting member 2200 may have other shapes as desired, one example of which will be described below with reference to FIGS. 12A and 12B. The mounting bracket 2300 is integral with the mounting member 2200 upon manufacture but can be detached for use in hanging the support structure 2050 from the support surface.

Figure 11C:
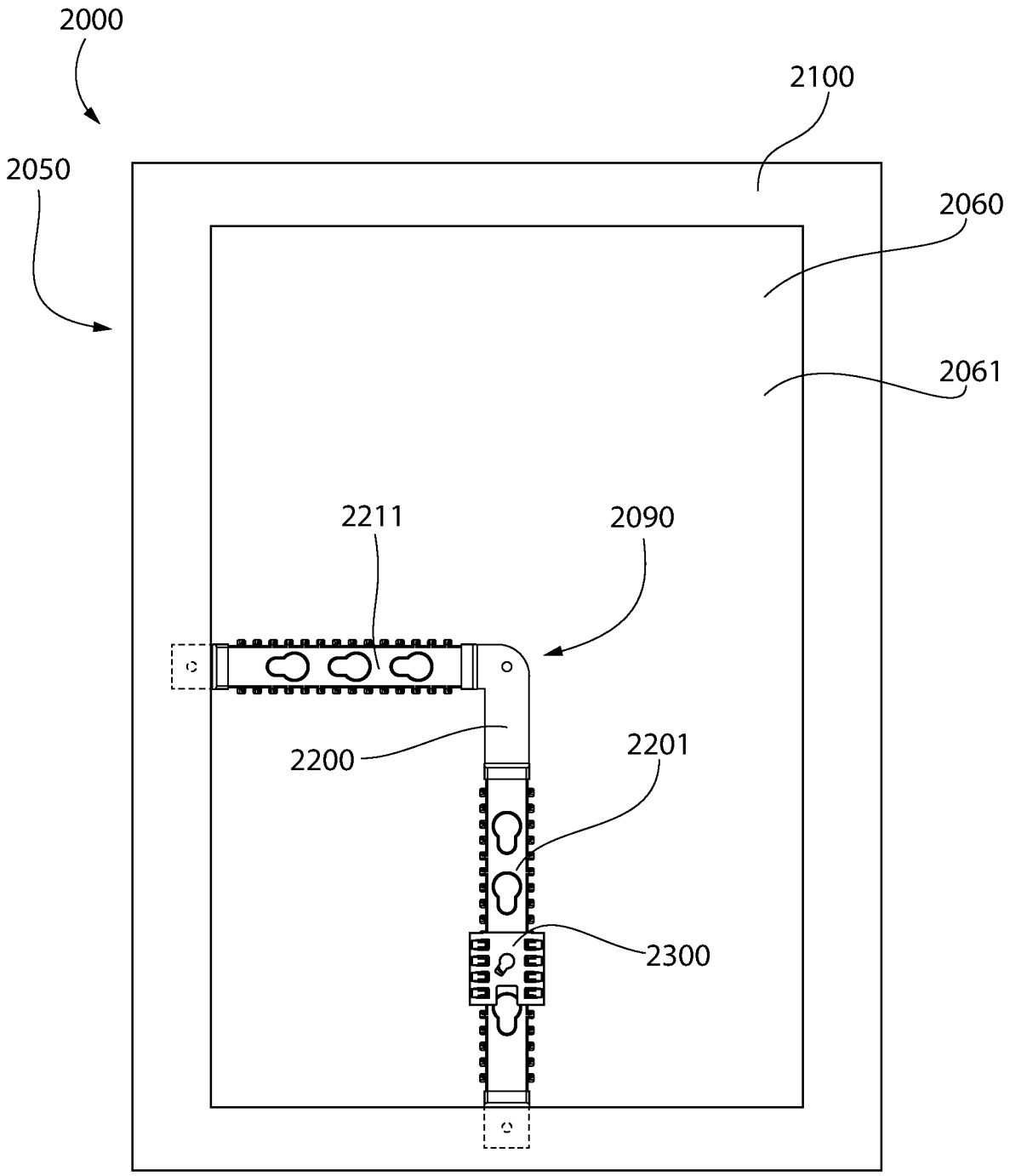
FIG. 11C is a rear view of the frame of FIG. 11A with the mounting member of the hanging assembly of FIG. 11B secured within a rabbet of the frame.

In FIG. 11A, the mounting member 2200 is coupled to a backer panel 2061 of the stack 2060. This can be achieved using rivets, nails, screws, bolts, adhesive, hook and loop, or any type of fastener. In FIG. 11C, the mounting member 2200 is trapped between the backer panel 2061 of the stack 2060 and a portion of the frame 2100. In other embodiments, the mounting member 2200 may be coupled directly to the frame 2100 (using any type of fastener such as those described herein above). The specific structural details of the mounting member 2200 is similar to that which has been described above and will not be described herein in detail.

In use, the mounting bracket 2300 is coupled to the support surface and then the support structure 2050 with the mounting member 2200 coupled thereto is moved into contact with the mounting bracket 2300 until the mounting elements of the mounting member 2200 engage the mounting elements of the mounting bracket 2300 as described above. The mounting member 2200 then couples to the mounting bracket 2300 to hang the support structure 2050 from the support surface. This process is the same as that which was described above with reference to FIGS. 8A-9D, with the only difference being that the hanging assembly is not integral with the frame in the embodiment of FIGS. 11A-11C as it was with the embodiment previously described.

Figure 12A:
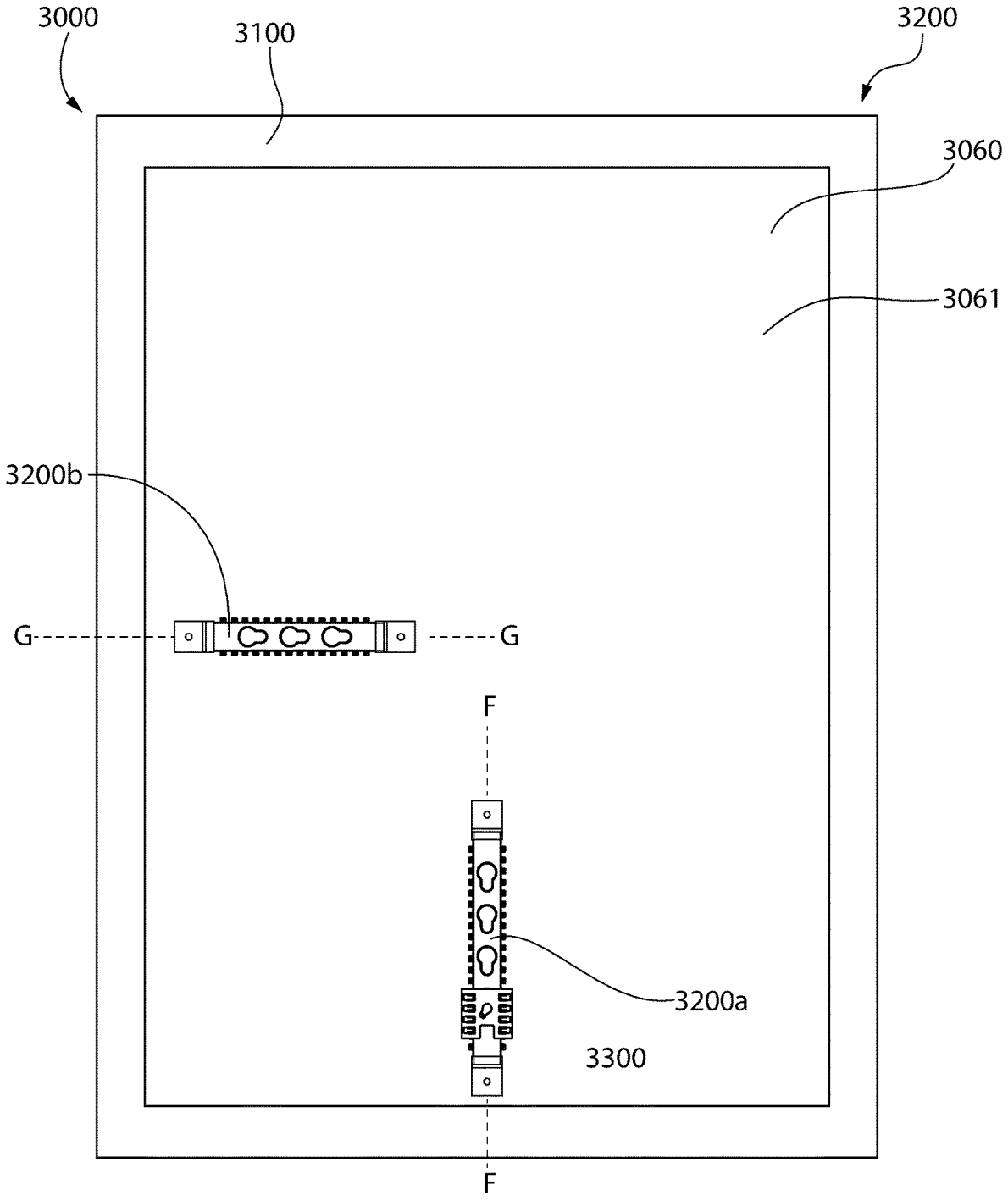
FIG. 12A is a rear view of a frame with a hanging assembly coupled thereto in accordance with yet another embodiment of the present invention.

FIG. 12A illustrates a frame apparatus 3000 that is identical to the frame apparatus 2000 except that it includes a hanging assembly 3290 that comprises a mounting bracket 3300, a first mounting member 3200*a* and a second mounting member 3200*b*. Thus, in FIGS. 11A-11C, the mounting member 2200 is a single unitary component having an "L" shape and in FIG. 12A there are two separate mounting members 3200*a*, 3200*b* that can be oriented as desired along the support structure 3050 (including orienting them perpendicularly to one another as shown in FIG. 12A). The frame apparatus 3000 comprises a frame 3100 and a stack 3060, with the stack 3060 comprising a backer panel 3061.

Figure 12B:
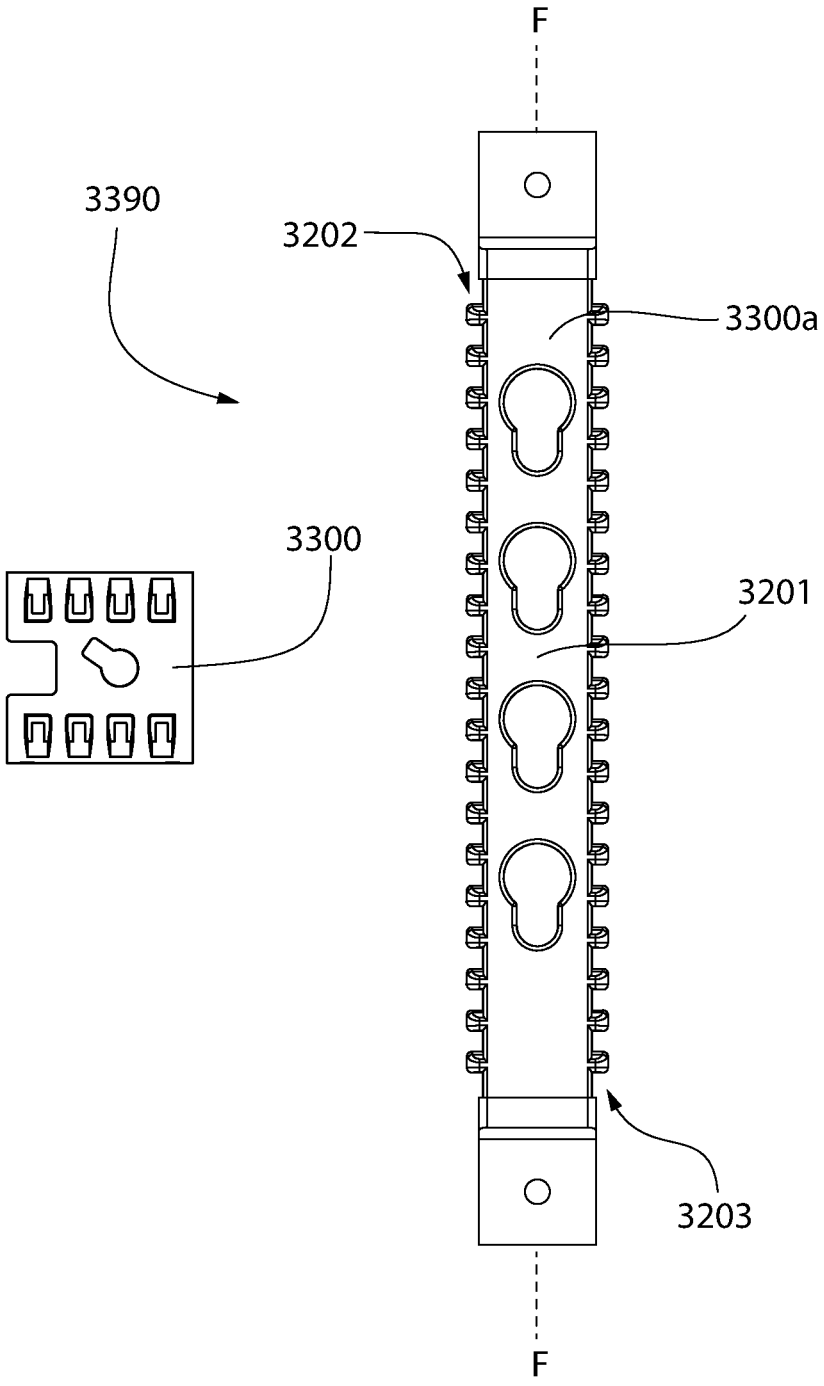
FIG. 12B is a front view of the hanging assembly of FIG. 12A.

FIG. 12B illustrates the hanging assembly 3390 comprising the first mounting member 3200*a* and the mounting bracket 3300. In some embodiments, the hanging assembly 3390 may comprise only the first mounting member 3200*a* and the mounting bracket 3300 without also including the second mounting member 3200*b*. The mounting bracket 3300 could be formed integrally with the first mounting member 3200*a* in a detachable manner, or the mounting bracket 3300 could be formed separately from the first mounting component 3200*a*. All components of the hanging assembly 3390 could be formed of plastic, metal, wood, or other rigid materials that can support the frame apparatus 3000 from a support surface such as a wall.

The first mounting component 3200*a* comprises a body portion 3201 that extends along an axis F-F, a plurality of first mounting elements 3202 protruding from the body portion 3201 on a first side of the axis F-F, and a plurality of second mounting elements 3203 protruding from the body portion 3201 on a second side of the axis F-F. The plurality of first mounting elements 3202 are axially spaced apart from one another. The plurality of second mounting elements 3203 are axially spaced apart from one another. The first mounting member 3200*a* is generally the same structurally as the mounting members 120, 150 described above except that it is not formed integrally with a frame but is instead a separate component that can be coupled to a frame, as shown in FIG. 12A. Thus, the first and second mounting elements 3202, 3203 comprise protrusions and stopper ribs as described in detail above. The mounting bracket 3300 is identical structurally to the mounting bracket 200 and thus the mounting bracket 3300 will not be described in detail in the interest of brevity, it being understood hat the description of the mounting bracket 200 is applicable.

FIG. 12A illustrates the first mounting member 3200*a* and the second mounting member 3200*b* coupled to a backer panel 3061 of the stack 3060. The first and/or second mounting members 3200*a*, 3200*b* may instead be coupled directly to the frame 3100 or may be sandwiched between the backer panel 3061 and a floor of a rabbet in which the stack 3060 nests. In this embodiment, the first mounting member 3200*a* extends along the first axis F-F and the second mounting member 3200*b* extends along a second axis G-G that is perpendicular to the first axis F-F. This allows for the frame apparatus 3000 to be hung in portrait orientation using the first mounting member 3200*a* and landscape orientation using the second mounting member 3200*b*.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A hanging assembly for hanging an article from a support surface, the hanging assembly comprising:

a mounting member comprising a body portion extending along a first axis, a plurality of first mounting elements extending from the body portion on a first side of the first axis and arranged in an axially spaced apart manner, and a plurality of second mounting elements extending from the body portion on a second side of the first axis and arranged in an axially spaced apart manner;

a mounting bracket extending along a second axis, the mounting bracket comprising a floor, a first sidewall extending from the floor on a first side of the second axis, and a second sidewall extending from the floor on a second side of the second axis, at least one third mounting element extending from an inner surface of the first sidewall towards the second axis and at least one fourth mounting element extending from an inner surface of the second sidewall towards the second axis;

a plurality of hanging apertures formed through the body portion of the mounting member and arranged in an axially spaced apart manner, each of the hanging apertures configured to receive a portion of a piece of hardware that is protruding from a support surface to hang the mounting member from the support surface; and wherein the mounting member is coupled to the mounting bracket via engagement between: (1) a first subset of the first mounting elements of the mounting member and the at least one third mounting element of the mounting bracket; and (2) a second subset of the second mounting elements of the mounting member and the at least one fourth mounting element of the mounting bracket.

2. The hanging assembly according to claim 1 wherein an axial position of the mounting bracket along the mounting member is adjustable by changing which of the pluralities of first and second mounting elements of the mounting member form the first and second subsets.

3. The hanging assembly according to claim 1 wherein each of the first mounting elements is aligned with one of the second mounting elements such that a transverse axis that is perpendicular to the first axis intersects one of the first mounting elements and one of the second mounting elements.

4. The hanging assembly according to claim 1 wherein the floor and the first and second sidewalls of the mounting bracket collectively define a cavity, and wherein a portion of the body portion of the mounting member nests within the cavity when the mounting member is coupled to the mounting bracket.

5. The hanging assembly according to claim 1 wherein the mounting member is configured to be coupled to or integrally formed with a frame, wherein the mounting bracket is configured to be mounted on a support surface, and wherein changing which of the first and second mounting elements of the mounting member form the first and second subsets modifies a hanging height of the frame on the support surface.

6. The hanging assembly according to claim 1 wherein each of the plurality of first mounting elements and each of the plurality of second mounting elements comprises a protrusion extending from the body portion in a direction away from the first axis and a stopper rib extending from the body portion and being connected directly to the protrusion at a top end of the protrusion.

7. The hanging assembly according to claim 6 wherein when the mounting bracket is coupled to the mounting member: (1) the stopper ribs of the first subset of the first mounting elements rest atop the at least one third mounting element of the mounting bracket and a front surface of the protrusions of the first subset of the first mounting elements abut a rear surface of the at least one third mounting element of the mounting bracket; and (2) the stopper ribs of the second subset of the second mounting elements rest atop of the at least one fourth mounting element of the mounting bracket and a front surface of the protrusions of the second subset of the second mounting elements abut a rear surface of the at least one fourth mounting element of the mounting bracket.

8. The hanging assembly according to claim 1 wherein each pair of adjacent ones of the first mounting elements are spaced apart by a first gap and each pair of adjacent ones of the second mounting elements are spaced apart by a second gap, and wherein coupling the mounting bracket to the mounting member comprises passing the at least one third mounting element through one of the first gaps and passing the at least one fourth mounting element through one of the second gaps and then lowering the mounting member relative to the mounting bracket until a stopper rib of one of the first mounting elements rests atop the at least one third mounting element of the mounting bracket and a stopper rib of one of the second mounting elements rests atop the at least one fourth mounting element of the mounting bracket.

9. The hanging assembly according to claim 1 further comprising a plurality of the third mounting elements extending from the inner surface of the first sidewall in an axially spaced apart manner and a plurality of the fourth mounting elements extending from the inner surface of the second sidewall in an axially spaced apart manner.

10. The hanging assembly according to claim 9 wherein there are more of the first mounting elements than there are of the third mounting elements and there are more of the second mounting elements than there are of the fourth mounting elements.

11. A hanging assembly for hanging a frame apparatus from a support surface, the hanging assembly comprising:

a mounting member configured to be coupled to the frame apparatus, the mounting member comprising a body portion extending along a first axis, a plurality of first mounting elements extending from the body portion on a first side of the first axis, and a plurality of second mounting elements extending from the body portion on a second side of the first axis, each of the first and second mounting elements comprising a protrusion and a stopper rib;

a mounting bracket configured to be mounted directly to a support surface, the mounting bracket comprising a main portion extending along a second axis, a first sidewall extending from the main portion and comprising a plurality of third mounting elements located on a first side of the second axis, and a second sidewall extending from the main portion and comprising a plurality of fourth mounting elements located on a second side of the second axis; and wherein the mounting member is coupled to the mounting bracket to hang the frame apparatus from the support surface via engagement between: (1) a first subset of the first mounting elements of the mounting member and the plurality of third mounting elements of the mounting bracket, such that each of the stopper ribs of the first subset of the first mounting elements of the mounting member rests atop one of the third mounting elements of the mounting bracket and each of the protrusions of the first subset of the first mounting elements of the mounting member is positioned behind between one of the third mounting elements of the mounting bracket and the main portion of the mounting bracket in a direction transverse to the second axis; and (2) a second subset of the second mounting elements of the mounting member and the plurality of fourth mounting elements of the mounting bracket, such that each of the stopper ribs of the second subset of the second mounting elements of the mounting member rests atop one of the fourth mounting elements of the mounting bracket and each of the protrusions of the second subset of the second mounting elements of the mounting member is positioned behind between one of the fourth mounting elements of the mounting bracket and the main portion of the mounting bracket in the direction transverse to the second axis.

12. The hanging assembly according to claim 11 wherein the first mounting elements are axially spaced apart from one another, the second mounting elements are axially spaced apart from one another and in alignment with the first mounting elements, the third mounting elements are axially spaced apart from one another, and the fourth mounting elements are axially spaced apart from one another and in alignment with the third mounting elements.

13. The hanging assembly according to claim 11 wherein the first and second mounting elements extend from the body portion of the mounting member in a direction away from the first axis, and wherein the third and fourth mounting elements extend from the body portion of the mounting bracket in a direction towards the second axis.

14. The hanging assembly according to claim 11 wherein the first and second axes are the same when the mounting member is coupled to the mounting bracket.

15. A frame apparatus comprising:

a support structure comprising a frame having an inner surface defining a display opening configured to support a display item;

a first mounting member attached to or integrally formed with the support structure, the first mounting member comprising a base portion located within the display opening and extending along a first axis, a plurality of first mounting elements located on a first side of the first axis and arranged in an axially spaced apart manner, and a plurality of second mounting elements located on a second side of the first axis and arranged in an axially spaced apart manner;

a mounting bracket comprising an aperture configured to receive an article of hardware to couple the mounting bracket to a support surface, the mounting bracket extending along a second axis, the mounting bracket comprising at least one third mounting element located on a first side of the second axis and at least one fourth mounting element located on a second side of the second axis; and wherein the first mounting member is configured to be coupled to the mounting bracket via engagement between: (1) a first subset of the plurality of first mounting elements of the first mounting member and the at least one third mounting element of the mounting bracket; and (2) a second subset of the plurality of second mounting elements of the first mounting member and the at least one fourth mounting element of the mounting bracket.

16. The frame apparatus according to claim 15 further comprising:

a second mounting member attached to or integrally formed with the support structure, the second mounting member located within the display opening and extending along a third axis that is perpendicular to the first axis, the second mounting member comprising a plurality of first mounting elements located on a first side of the third axis and arranged in an axially spaced apart manner and a plurality of second mounting elements located on a second side of the third axis and arranged in an axially spaced apart manner; and wherein the second mounting member is configured to be coupled to the mounting bracket via engagement between: (1) a third subset of the plurality of first mounting elements of the second mounting member and the at least one third mounting element of the mounting bracket; and (2) a fourth subset of the plurality of second mounting elements of the second mounting member and the at least one fourth mounting element of the mounting bracket.

17. The frame apparatus according to claim 16 wherein each of the first mounting elements of the first mounting member is aligned with one of the second mounting elements of the first mounting member, and wherein each of the first mounting elements of the second mounting member is aligned with one of the second mounting elements of the second mounting member.

18. The frame apparatus according to claim 15 further comprising:

wherein each of the first mounting elements of the first mounting member comprises:

a first protrusion having a front surface, a rear surface, a top end, and a bottom end; and a first stopper rib extending from the front surface of the protrusion adjacent to the top end of the protrusion; and wherein each of the second mounting elements of the first mounting member comprises:

a second protrusion having a front surface, a rear surface, a top end, and a bottom end; and a second stopper rib extending from the front surface of the protrusion adjacent to the top end of the protrusion; and wherein the at least one third mounting element of the mounting bracket comprises one or more third protrusions and the at least one fourth mounting element of the mounting bracket comprises one or more fourth protrusions, each of the third and fourth protrusions having a front surface, a rear surface, a top end, and a bottom end.

19. The frame apparatus according to claim 18 wherein when the first mounting member is coupled to the mounting bracket, the first stopper protuberances of each of the first mounting elements of the first subset rests atop of the top end of one of the third protrusions of the at least one third mounting element of the mounting bracket while the rear surfaces of the first protrusions of the first mounting elements of the first subset face the front surfaces of the third protrusions of the at least one third mounting element of the mounting bracket, and the second stopper protuberances of each of the second mounting elements of the second subset rests atop of the top end of one of the fourth protrusions of the at least one fourth mounting element of the mounting bracket while the rear surfaces of the second protrusions of the second mounting elements of the second subset face the front surfaces of the fourth protrusions of the at least one fourth mounting element of the mounting bracket.

20. The frame apparatus according to claim 15 further comprising a plurality of hanging apertures formed through the base portion of the first mounting member and arranged in an axially spaced apart manner, each of the hanging apertures configured to receive a portion of a piece of hardware that is protruding from the support surface to hang the mounting member directly from the support surface.

* * * * *